US007937983B2

(12) United States Patent
Yoshimura et al.

(10) Patent No.: US 7,937,983 B2
(45) Date of Patent: May 10, 2011

(54) CURVED SURFACE FORMING APPARATUS, OPTICAL SCANNING APPARATUS, AND IMAGE FORMING APPARATUS

(75) Inventors: Kenichi Yoshimura, Kawasaki (JP); Kouji Terasawa, Morioka (JP)

(73) Assignee: Ricoh Company, Ltd., Tokyo (JP)

( * ) Notice: Subject to any disclaimer, the term of this patent is extended or adjusted under 35 U.S.C. 154(b) by 480 days.

(21) Appl. No.: 12/112,579

(22) Filed: Apr. 30, 2008

(65) Prior Publication Data

US 2008/0271513 A1 Nov. 6, 2008

(30) Foreign Application Priority Data

May 1, 2007 (JP) ..... 2007-120824
Nov. 14, 2007 (JP) ..... 2007-295740

(51) Int. Cl.
*H01Q 15/20* (2006.01)
*G02B 5/10* (2006.01)

(52) U.S. Cl. ..... 72/380; 343/915; 359/846; 359/847

(58) Field of Classification Search ..... 72/380; 359/846, 847, 849; 343/915
See application file for complete search history.

(56) References Cited

U.S. PATENT DOCUMENTS 4,022,523 A * 5/1977 Lindonen et al. ..... 359/849
4,162,825 A * 7/1979 Dowty ..... 359/847
5,559,581 A 9/1996 Sugiura et al.
6,208,317 B1 * 3/2001 Taylor et al. ..... 343/915
6,472,115 B2 10/2002 Uezono et al.
6,915,677 B1 * 7/2005 Tolomeo ..... 72/380
2007/0030538 A1 2/2007 Hirakawa et al.
2008/0025750 A1 1/2008 Yamazaki et al.
2008/0068692 A1 3/2008 Yoshimura

FOREIGN PATENT DOCUMENTS

JP 6-317960 11/1994
JP 2000-147417 5/2000
JP 2001-277594 10/2001
JP 3324302 7/2002
JP 2002-277796 9/2002
JP 2004-77870 3/2004
JP 2004-249677 9/2004
JP 2004-264680 9/2004
JP 2004-333994 11/2004
JP 2005-156625 6/2005
JP 2005-300778 10/2005
JP 2005-338575 12/2005
JP 2006-17881 1/2006
JP 2006-163141 6/2006
JP 2006-267137 10/2006
JP 2007-41420 2/2007
JP 2007-65125 3/2007
JP 2007-79400 3/2007

* cited by examiner

*Primary Examiner* — David B Jones
(74) *Attorney, Agent, or Firm* — Oblon, Spivak, McClelland, Maier & Neustadt, L.L.P.

(57) ABSTRACT

A curved surface forming apparatus includes a first member to be curved; a second member which is placed with a distance from the first member and holds the first member; and a pressurizing mechanism which pressurizes the first member and the second member to curve at least a part of the first member toward at least the second member.

16 Claims, 21 Drawing Sheets

CURVED SURFACE FORMING APPARATUS, OPTICAL SCANNING APPARATUS, AND IMAGE FORMING APPARATUS

CROSS REFERENCE TO RELATED APPLICATIONS

The present application is based on and claims priority from each of Japanese Patent Application Nos. 2007-120824, filed on May 1, 2007 and 2007-295740, filed on Nov. 14, 2007, the disclosure of which is hereby incorporated by reference herein in its entirety.

BACKGROUND OF THE INVENTION

1. Field of the Invention

The present invention relates to a curved surface forming apparatus that is capable of forming a curved surface and adjusting and holding the formed curved surface, an optical scanning apparatus to which the curved surface forming apparatus is applied, and an image forming apparatus that includes the optical scanning apparatus.

2. Description of Related Art

In recent years, there have been developed various techniques for an optical writing apparatus and image forming apparatus that are capable of reducing curvature of a scanning line formed by a light beam.

For example, Japanese Patent No. 3324302 discloses an image forming apparatus. This image forming apparatus includes a reflecting mirror that forms part of a light beam scanning optical system, and receives and reflects a light beam by a part of a first surface between a first position and a second position different from the first position; a mirror supporting mechanism that is in contact with the first surface receiving the light beam and supports the first surface at two positions having a scanning area, which connects the first position and the second position of the first surface, interposed therebetween with a predetermined distance; a first pressing mechanism that presses both end portions on a second surface of the reflecting mirror, the second surface being not supported by the mirror supporting mechanism; a second pressing mechanism that presses the second surface at a position closer to center from a portion of the reflecting mirror supported by the mirror supporting mechanism; and a pressing force adjusting mechanism that adjusts a pressing force produced by the second pressing mechanism according to curvature of an optical system. The pressing force adjusting mechanism adjusts curvature of a scanning line formed by the optical beam by allowing adjustment of the pressing force that deflects the reflecting mirror in an optical scanning path. The pressing force adjusting mechanism, which adjusts the pressing force that deflects the reflecting mirror, has an adjusting screw, an adjusting plate to which the adjusting screw is attached, and a fixing member that fixes the adjusting plate.

However, in the case of the image forming apparatus disclosed in Japanese Patent No. 3324302, a large number of parts and assembling steps required to produce the pressing force adjusting mechanism lead to the complex structure. This results in difficulty in responding to the request that the mechanism can adjust the curvature of the scanning line in a narrow region, and poor flexibility in light-ray bending arrangement in the optical scanning apparatus. Thus, there are problems that it is difficult to achieve miniaturization of the entire image forming apparatus, and that such complex structure of the pressing force adjusting mechanism causes an increase in manufacturing cost.

Meanwhile, for example, Japanese Patent Application Publication No. 2006-017881 discloses an optical writing apparatus having an optical housing in which multiple optical members are arranged to irradiate corresponding photoreceptors with scanning lines formed by light beams emitted from multiple light sources. This optical writing apparatus includes a holding member that holds a reflecting mirror, and a scanning line curvature adjusting mechanism. Here, the reflecting mirror is one of the optical members and is provided on an optical path of each light beam. The scanning line curvature adjusting mechanism is provided at a substantially central portion in a longitudinal direction of the reflecting mirror and adjusts the amount of deflection of the reflecting mirror in a direction in which the reflecting mirror curves in a concave or convex shape with respect to an incident direction of the light beam entering the reflecting mirror.

However, in the optical writing apparatus disclosed in Japanese Patent Application Publication No. 2006-017881, the scanning line curvature adjusting mechanism has a structure that adjusts fluctuations in the amount of curvature of the reflecting mirror after setting the reflecting mirror to have any one of a concave curvature and a convex curvature with application of an initial pressing force. As a result, there is difficulty in providing a wide range of adjusting area crossing over curvature 0 (infinity R) from concave to convex or conversely from convex to concave. Therefore, even if the curvature of a scanning line is minute, adjustment work must be carried out as in the conventional optical system, and this causes problems of increasing the number of adjusting steps and its manufacturing cost.

SUMMARY OF THE INVENTION

At least an object of the present invention is to provide a curved surface forming apparatus that is capable of forming curved surfaces of various sizes with a simple and low-cost structure and adjusting and holding the formed curved surface appropriately.

Another object of the present invention is to provide an optical scanning apparatus, which includes the aforementioned curved surface forming apparatus, whereby particularly a scanning line curvature is capable of being adjusted precisely.

A further object of the present invention is to provide an image forming apparatus such as a printer, a copying machine or the like that includes the aforementioned curved surface forming apparatus and the optical scanning apparatus capable of adjusting a scanning line curvature precisely.

According to an aspect of the present invention, a curved surface forming apparatus includes a first member to be curved; a second member which is placed with a distance from the first member and holds the first member; and a pressurizing mechanism which pressurizes the first member and the second member and curves at least a part of the first member at least toward the second member side.

According to another aspect of the present invention, an optical scanning apparatus includes the aforementioned curved surface forming apparatus and scans an object with a light beam.

According to a further aspect of the present invention, an image forming apparatus includes the aforementioned optical scanning apparatus and forms an image on an object.

DETAILED DESCRIPTION OF THE PREFERRED EMBODIMENTS

The following will specifically explain preferred embodiments of the present invention with reference to the drawings.

Each of FIGS. 1A to 1E shows a curved surface forming apparatus according to a first embodiment of the present invention.

Figure 1A:
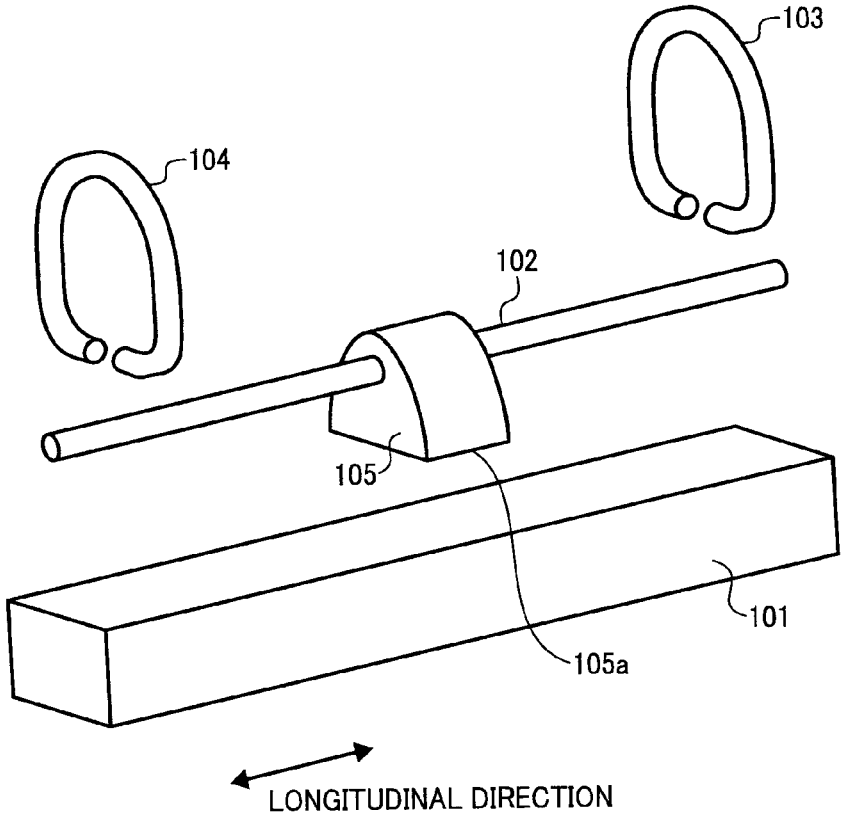
FIG. 1A is an exploded perspective view of a curved surface forming apparatus according to a first embodiment of the present invention.
Figure 1B:
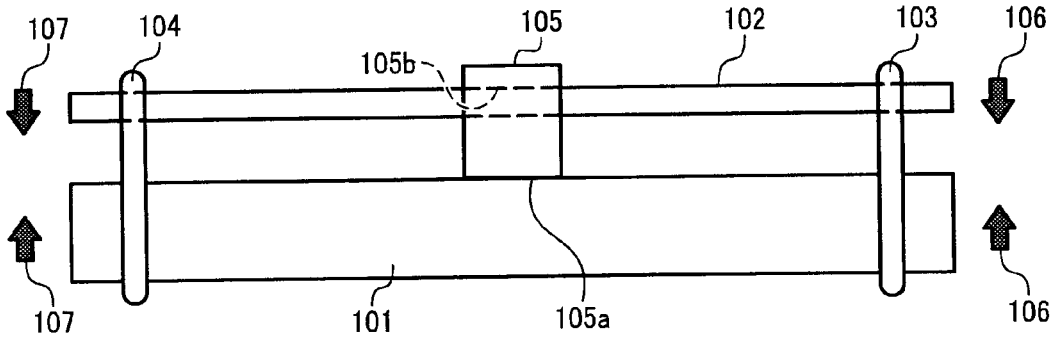
FIG. 1B is an elevation view showing a state that the curved surface forming apparatus according to the first embodiment of the present invention is assembled.

Each of FIGS. 1A and 1B shows a structure of the curved surface forming apparatus. The curved surface forming apparatus includes a first member 101 to be deformed, particularly, curved, a second member 102 that is placed to be opposed to the first member 101 with a distance and holds the first member 101, and a pressurizing mechanism that applies a force to the first member 101 and the second member 102 to curve the first member 101. The first member 101 is, for example, formed of an elongated and deformable curving member 101, which has a rectangular cross section, and the second member 102 is formed of an elongated rod-shaped holding member 102 which extends along the curving member 101 (the first member) and is placed with a distance from the curving member 101. The pressurizing mechanism is formed of, for example, two pressure members 103 and 104 provided such that both ends of each of the curving member 101 and the holding member 102 are connected to each other to deform the curving member 101.

These pressure members 103 and 104 have, for example, elastic forces having a predetermined magnitude, and can appropriately deform the curving member 101 in a shape of arch, waveform or the like along its longitudinal direction while applying loads generated by the elastic forces to both ends of each of the curving member 101 and the holding member 102. It is noted that the pressurizing mechanism can have various structures to apply deformation to the curving member 101 without being limited to the aforementioned pressure members having the elastic forces.

In the first embodiment, the pressure members 103 and 104 have ring shapes as shown in FIG. 1A, and are attached to the curving member 101 and the holding member 102 at appropriate positions such that they can move along the longitudinal directions of the curving member 101 and the holding member 102.

The curving member 101 and the holding member 102 are arranged with a predetermined space therebetween by a spacer. In the first embodiment, the spacer is formed of a rigid intermediate holding member 105 placed at a substantially central portion of each of the curving member 101 and the holding member 102. The intermediate holding member 105 has a hole 105*b* through which the holding member 102 is movably inserted and a contact portion 105*a* that comes in contact with the curving members 101.

Attracting forces 106 and 107, generated by the pressure members 103 and 104 respectively, make the curving member 101 and the holding member 102 draw each other. Here, the shape of the pressure member 103 and that of the pressure member 104 can be the same, or can be different in order to conform to the shapes and requested deformation states of the curving member 101 and the holding member 102. The curving member 101 and the holding member 102 are deformed by a predetermined amount by the attracting forces, but they are set to have strength such that no plastic deformation occurs. Ideally, the contact portion 105*a* is in point or edge contact with the curving member 101, but is allowed to be in surface contact therewith if it does not inhibit a desired curved state.

Figure 1C:
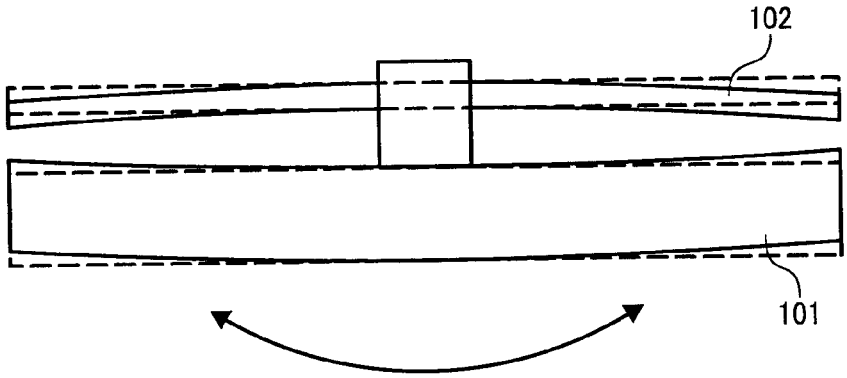
FIG. 1C is an explanatory view explaining a function of the curved surface forming apparatus according to the first embodiment of the present invention.
Figure 1D:
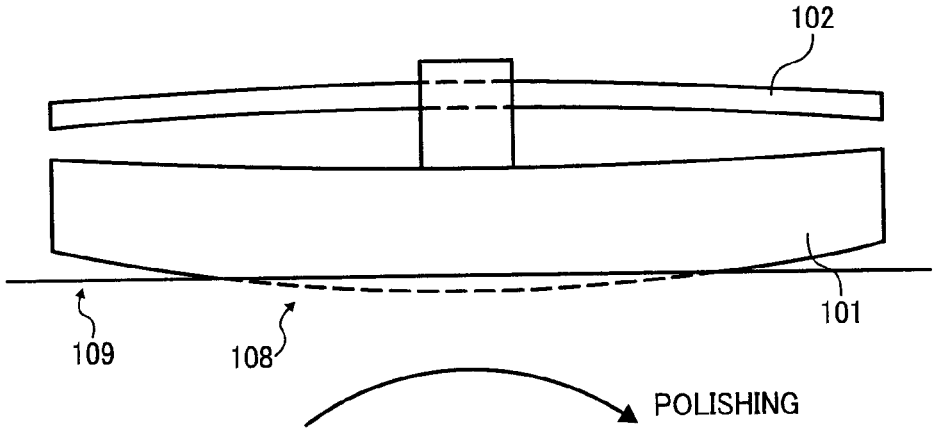
FIG. 1D is an explanatory view explaining a function of the curved surface forming apparatus according to the first embodiment of the present invention.

In this embodiment, the attracting forces 106 and 107 are applied to portions away from the contact portion 105*a*, that is, both ends of the curving member 101 by the pressure members 103 and 104 (see FIG. 1B), and thus deformation occurs in the curving member 101 according to its rigidity, that is, its flexural elastic force and attracting forces 106 and 107 (see FIGS. 1C and 1D).

In FIG. 1C, downward convex curved deformation is produced in the curving member 101. Here, it is possible to appropriately set the magnitude of the attracting forces 106 and 107 with consideration given to elasticity of the curving member 101 and the holding member 102 and the distance therebetween in order to obtain a predetermined amount of curvature.

Figure 1E:
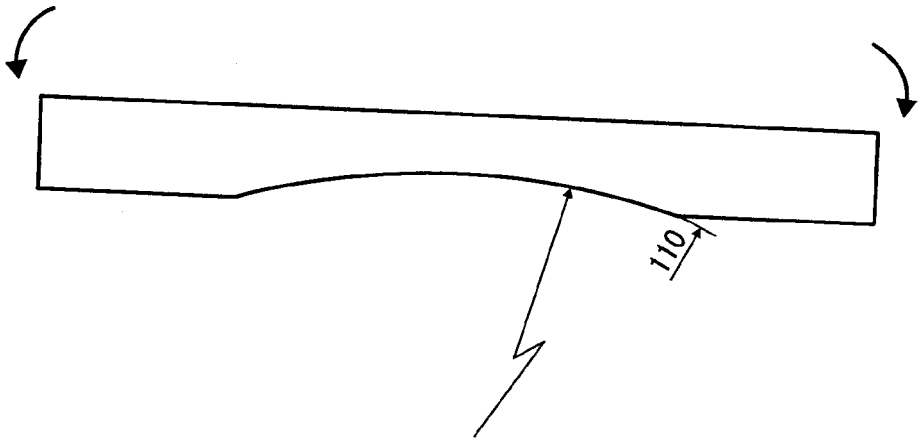
FIG. 1E is an explanatory view explaining a function of the curved surface forming apparatus according to the first embodiment of the present invention.

FIG. 1D shows one of application examples of a curve forming apparatus according to the present invention. The curving member 101 curved by the pressure members (not shown) is in a cantilever state with respect to both directions using the contact portion 105 as a fulcrum, so that a predetermined curved surface 108 is formed. The curved surface 108 is appropriately held and the curving member 101 is ground or cut at a position of a plane 109 and then the holding member 102 is removed and the curving member 101 is released from the attracting forces. As a result, as shown in FIG. 1E, curvature of the curving member 101 is recovered within the elastic limit, and a curved surface 110 deformed in an upward convex shape is formed on the lower surface of the curving member 101.

Figure 2:
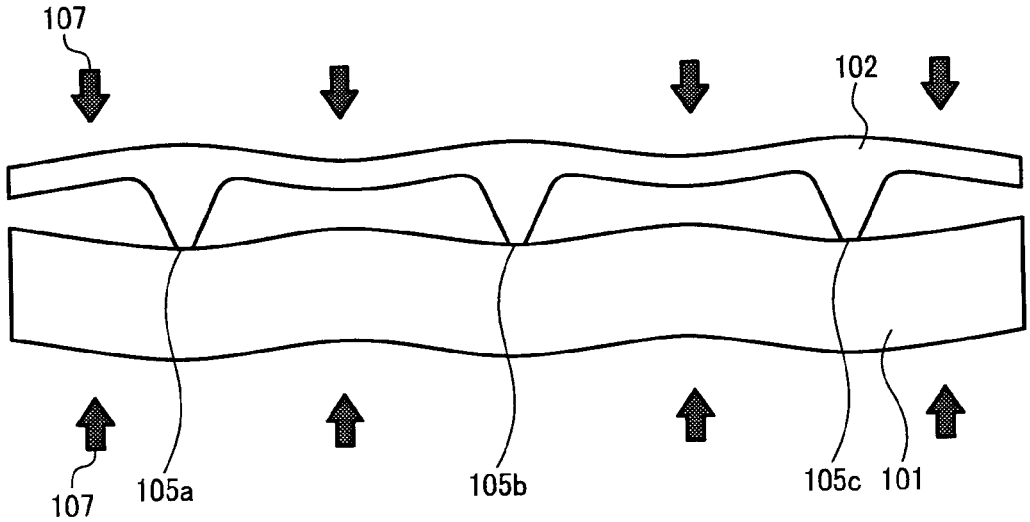
FIG. 2 is a schematic view showing a curved surface forming apparatus according to a second embodiment of the present invention

FIG. 2 shows a second embodiment of the curved surface forming apparatus according to the present invention. In this embodiment, the curving member 101 is disposed such that there is a space between the curving member 101 and the holding member 102 with the use of multiple spacers formed on the holding member 102. Here, in the second embodiment, these multiple spacers are formed of projections formed on the holding member 102 to have spaces in its longitudinal direction. Accordingly, the holding member 102 comes in contact with the curving member 101 at multiple contact portions 105*a*, 105*b*, and 105*c* each formed on the top end of each of the projections. In the second embodiment, multiple attracting forces 107 are applied to the curving member 101, by a pressurizing mechanism (not shown), between the contact portions 105*a* and 105*b*, between the contact portions 105*b* and 105*c* and outside the contract portions 105*a* and 105*c* (see FIG. 2). In this case, the pressurizing mechanism is formed of multiple pressure members each having a ring shape, and these pressure members are stretched onto the curving member 101 and the holding member 102 between one contact portion and another among the contact portions 105*a*, 105*b* and 105*c*. This makes it possible to produce a predetermined waveform deformation on the curving member 101 as shown in FIG. 2.

Figure 3A:
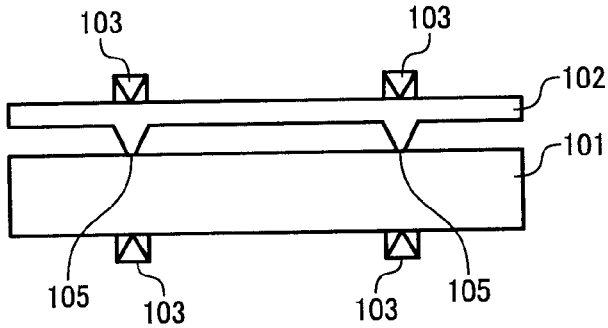
FIG. 3A is a schematic view showing a structure of a curved surface forming apparatus according to a third embodiment of the present invention
Figure 3B:
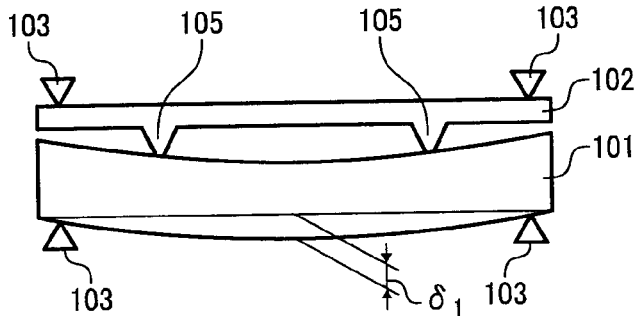
FIG. 3B is an explanatory view explaining a function of the curved surface forming apparatus according to the third embodiment of the present invention.
Figure 3C:
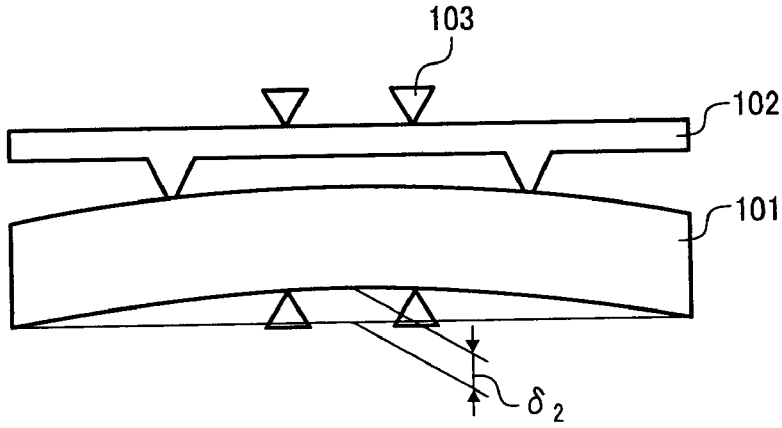
FIG. 3C is an explanatory view explaining a function of the curved surface forming apparatus according to the third embodiment of the present invention.

Each of FIGS. 3A, 3B, and 3C shows a curved surface forming apparatus according to a third embodiment. The curved member 101 comes in contact with the holding member 102 at two contact portions 105 and attracting forces are applied thereto by two pressure members 103 each having the same structure.

In the third embodiment, when flexural rigidity of the holding member 102 largely exceeds that of the curving member 101, the holding member 102 is little deformed and the majority of attracting forces contributes to the curvature of the curving member 101.

In FIG. 3A, each of two pressure members 103 is positioned just above each of the contact portions 105, and therefore the attracting forces act on the curving member 101 and the holding member 102 through the contact portions 105, but no bending moment about the contact portion 105 is generated and the curving member 101 is not deformed.

In FIG. 3B, the pressure members 103 are positioned outside the contact portions 105, and therefore bending moment about the contact portion 105 is generated and a minute downward convex deflection 61 is caused on the curving member 101 as shown in FIG. 3B. At this time, the curving member 101 has a continuous curvature; however, correctly speaking, a surface of the curving member 101 is not a curved surface having an even radius of curvature but a continuous surface having a suspended plane that gradually changes.

In FIG. 3C, the pressure members 103 are positioned inside the contact portions 105, and therefore bending moment about the contact portion 105 is generated and a minute downward concave deflection $-\delta_2$ is caused on the curving member 101 as shown in FIG. 3C. At this time, the curving member 101 has a continuous curvature; however, correctly speaking, a surface of the curving member 101 is not a curved surface having an even radius of curvature but a continuous surface having a suspended plane that gradually changes. Particularly, no bending moment is generated outside the contact portions 105 except the bending moment by self weight of the curving member 101, and only an inclination in a longitudinal direction of the curving member 101 is changed to be directed inwardly at its both ends.

As mentioned above, in the third embodiment, the positions of the pressure members 103 are changed with respect to the contact portions 105, thereby making it possible to change the amount of curvature of the curving member 101 and the concave and convex curvature directions.

Moreover, in the third embodiment, two pressure members 103, each having the same structure, are arranged symmetrically with respect to two contact portions 105 and attached to sandwich the curving member 101 and the holding member 102. Accordingly, the curving member 101 is symmetrically deformed, but when a desired curvature of the curving member 101 can not always be symmetric, the pressure members 103 can be non-symmetrically positioned or the attracting forces generated by the pressure members can be set to be different from each other.

Figure 4A:
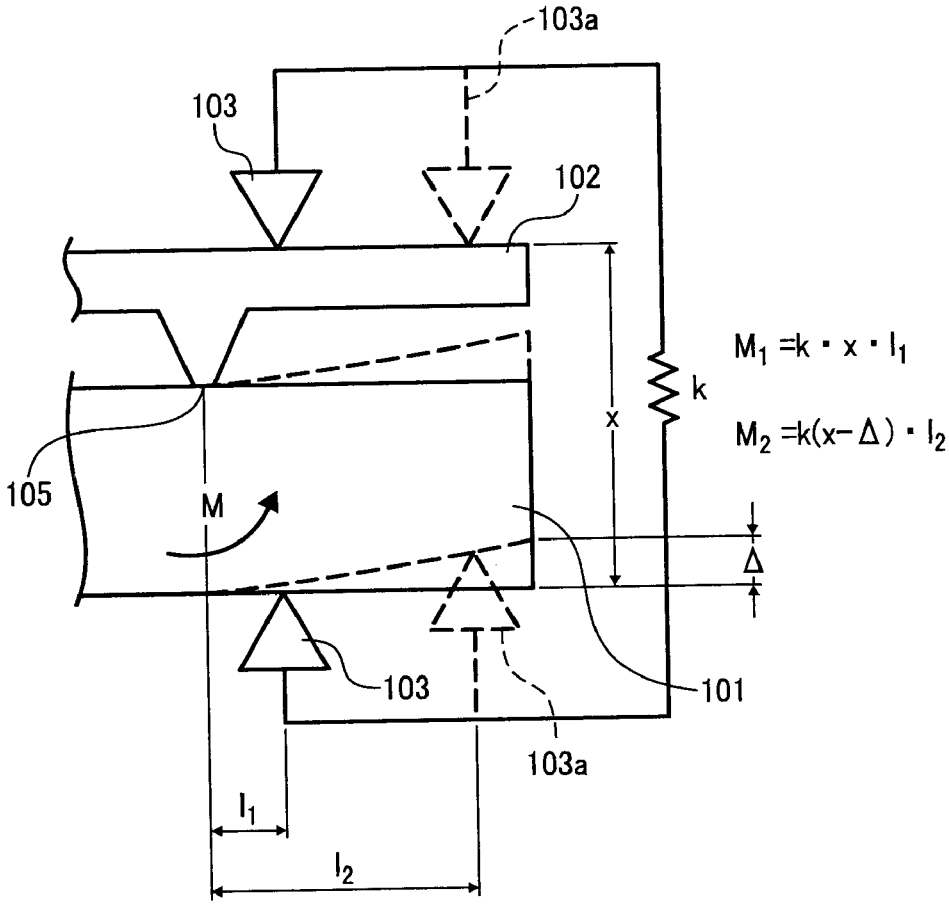
FIG. 4A is a partially explanatory view explaining a function of the curved surface forming apparatus according to a modification of the third embodiment of the present invention.
Figure 4B:
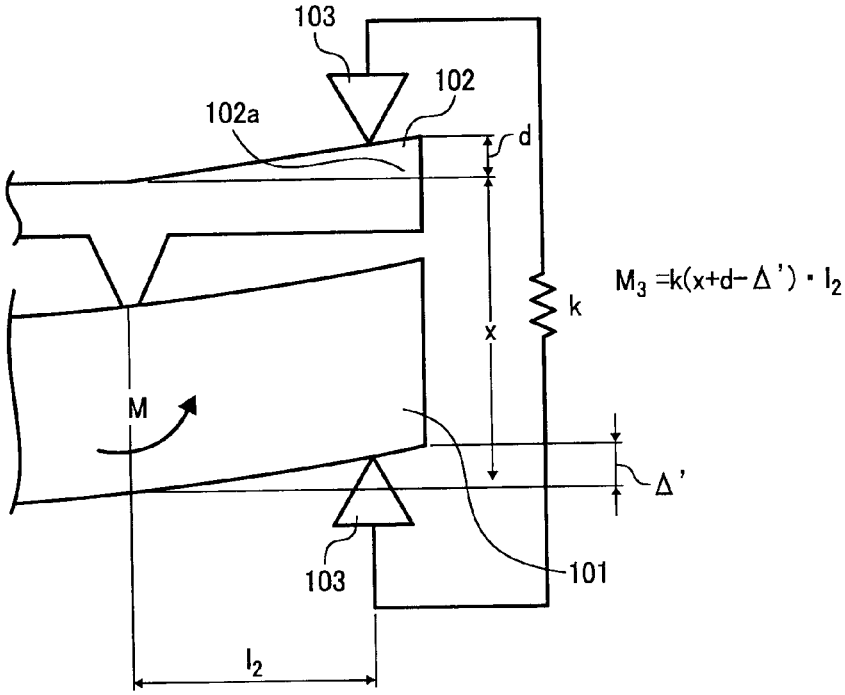
FIG. 4B is a partially explanatory view explaining a function of the curved surface forming apparatus according to a modification of the third embodiment of the present invention.

Each of FIGS. 4A and 4B schematically shows attracting forces and bending moment in the pressurizing mechanism and deflection of the curving member 101 in the curved surface forming apparatus according to the third embodiment of the present invention.

As shown in FIG. 4A, when the pressure member 103 generates an attracting force by its elastic force, a general expression of $M=k(x-\Delta)\cdot l$ is established in connection with moment that generates deflection increment $\Delta$ on the curving member 101. In this case, x denotes a distance between the lower surface of the curving member 101 and the upper surface of the holding member 102 at the time of setting up, k denotes a pseudo-tension spring constant of the pressure member 103, and $l(l_1,l_2)$ denotes a length between the contact portion of the holding member 102 and the pressure member 103 (103*a*).

Depending on a combination of the curving member 101, the holding member 102 and the elastic force of the pressure member 103, moment that acts on the curving member 101 is increased as the pressure member 103 is moved away from the contact portion 105 toward the end portion of the holding member 102. However, the distance between the curving member 101 and the holding member 102, that is, the distance between a pair of pressure portions, which sandwich the curving member 101 and the holding member 102, (hereinafter called as a pressure force acting distance), is narrowed by the amount corresponding to deflection $\Delta$ of the curving member 101, and thus the attracting force of the pressure member 103 is reduced and an increase in moment reaches the maximum. Therefore, even if a point of action of the pressure member 103 is changed to the position 103*a*, in some cases, a region where deflection does not occur is formed in the curving member 101. A reduction in attracting forces of the pressure members 103 means a reduction in attracting forces by which the curving member 101 and the holding member 102 are attracted to each other, causing a fear that mutual displacement occurs between the curving member 101 and the holding member 102 and that the pressure member 103 drops out.

Accordingly, as shown in FIG. 4B, in order to compensate for the reduction in attracting forces by deflection increment $\Delta'$, the pressure force acting distance is set, by the inventors of the present invention, to become larger at a place away from the contact portion 105 toward the end portion of the holding member 102. In this embodiment, an inclined shape 102*a* is provided on the surface of the holding member 102 that comes in contact with the pressure member 103 such that the pressure force acting distance is substantially greatly increased toward the end portion of the holding member 102 (see FIG. 4B). A deflection value is made larger than the deflection $\Delta$, which is determined depending on a combination of the curving member 101, the holding member 102 and the elastic force of the pressure member 103, and the pressure force acting distance is actually increased (d in the figure), thereby making it possible to wipe out the aforementioned fear. Moreover, by increasing the increment d in pressure force acting distance to exceed deflection increment $\Delta'$, it is possible to gradually increase the amount of curvature in a quadratic-function manner. Moreover, this structure makes it possible to increase the maximum value of change in bending moment to the curving member 101 effected by the position of the pressure member 103 in order to obtain a variation width of a desired amount of curvature. Moreover, in the case where it is impossible to apply sufficient curvature to the curving member 101 when rigidity of the curving member 101 is high and there is a limitation in arrangement, shape, quality, etc. of the members used, increment d of the pressure force acting distance is further increased, thereby allowing a desired amount of change in curvature to be ensured.

From the viewpoint opposite to the above, regarding the bending moment applied to the curving member 101, the pressure force acting distance is set to become smaller at a place away from the contact portion 105 in order to slow down the increase in bending moment effected by the position of the pressure member, thereby making it possible to reduce the change effected by the position of the pressure member and achieve a minute change in the amount around a certain amount of curvature.

At this time, when an opposite surface to a surface in contact with the holding member 102 (a holding member contact surface) is substantially plane in the curving member 101, the pressure force acting distance is a distance between a surface (profile surface) of the holding member 102 in contact with the pressure member 103, and the opposite surface of the curving member 101. Accordingly, bending moment applied to the curving member 101 can be optionally determined by the position of the contact portion of the holding member 102 and that of the pressure member 103 with respect to the curving member 101. Additionally, in FIG. 4A, $M_1$ and $M_2$ denote magnitude of the moment of the curving member 101 between $l_1$ and $l_2$, and in FIG. 4B, $M_3$ denotes magnitude of the moment of the curving member 101 with consideration given to deflection increment Δ'.

Figure 5A:
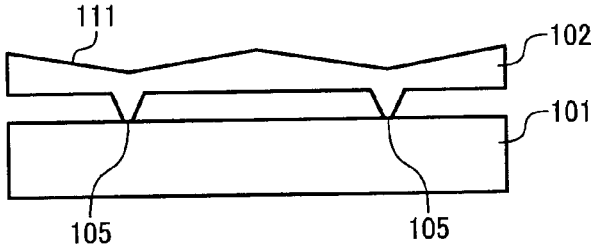
FIG. 5A is an elevation view showing a structure of a curved surface forming apparatus according to a fourth embodiment of the present invention.
Figure 5B:
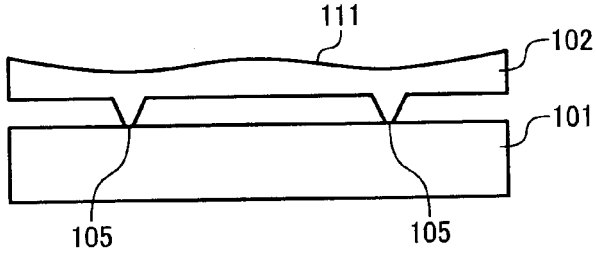
FIG. 5B is an elevation view showing a modification of the structure of the curved surface forming apparatus according to the fourth embodiment of the present invention.

FIGS. 5A and 5B show a curved surface forming apparatus according to a fourth embodiment of the present invention. As explained so far, a structure (profile surface 111), which changes the pressure force acting distance in a longitudinal direction, is applied to both outer and inner sides of two contact portions 105 in order to compensate for the reduction in attracting force generated by the deflection of the curving member 101 and to obtain a desired amount of curvature and a desired amount of change in curvature, thereby obtaining a structure in which the amount of curvature of the curving member 101 and the curved convex and concave portions are made variable by the position of the pressure member.

In FIGS. 5A and 5B, the curving member 101 is a long member having a rectangular cross section, and the opposite surface to the surface contacting the holding member 102 has a substantially plane and smooth surface. The pressure member (not shown) is attached to the curving member 101 and the profile surface 111, which is a surface where the pressure member comes in contact with the holding member 102.

When the pressure member is positioned just above the contact portion 105, the attracting force is applied. However, since there is no distance from a bending fulcrum, no bending moment is generated on the curving member 101 and no curvature is applied onto the curving member 101. As mentioned above, when the pressure member is positioned outside the contact portion 105, bending moment about the contact portion 105 is generated and downward convex deflection and curvature are generated on the curving member 101. Moreover, when the pressure member is positioned inside the contact portion 105, minute downward concave deflection and curvature are generated on the curving member 101.

The pressure force acting distance reaches the minimum near the contact portion 105 and is set to become larger at a place away from the contact portion 105 in the longitudinal direction. Therefore, the attracting force generated by the pressure member is increased as the pressure member goes away from the contact portion, so that even if the distance of movement of the pressure member is small, it is possible to increase the amount of change in bending moment and ensure the amount of curvature of the curing member 101.

In FIGS. 5A and 5B, the profile surface 111 is formed integrally with the holding member 102, but the holding member 102 and the profile surface 111 can be separately formed. Further, provision of the profile surface 111 allows improvement in strength and rigidity of the holding member 102.

Moreover, the profile surface 111 shown in FIG. 5A is formed by projection of a substantially straight line, which is easily formed, but this can be formed by projection of a smooth curved line as shown in FIG. 5B, and can be further formed by a three-dimensional curved surface.

Figure 6A:
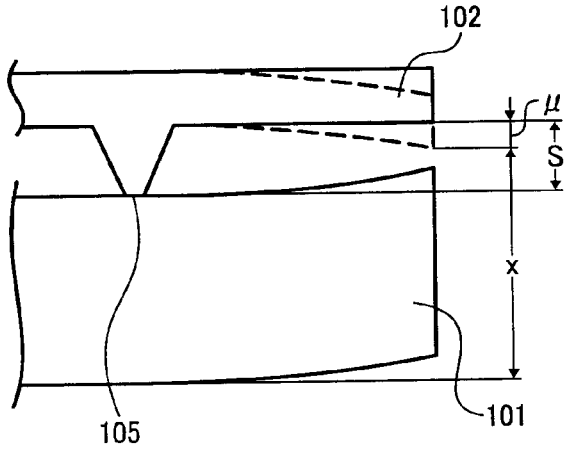
FIG. 6A is a partially explanatory view explaining a function of the curved surface forming apparatus according to a modification of the third embodiment of the present invention.
Figure 6B:
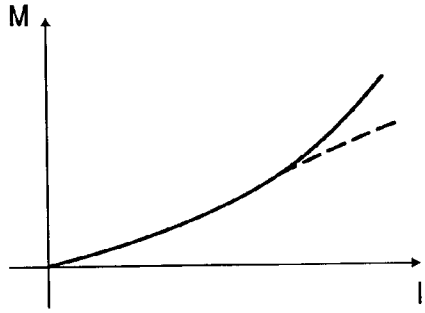
FIG. 6B is a graph showing distribution of moment in the curved surface forming apparatus according to the modification of the third embodiment of the present invention.

FIGS. 6A and 6B schematically show attracting forces, bending moment, and deflection of the holding member and that of the curving member in the curved surface forming apparatus having substantially the same structure as that of the third embodiment. In the description given so far, no reference has been made to deflection deformation of the holding member 102 produced by the attracting force of the pressure member, but the inventor of the present invention produced a curved surface forming apparatus according to the present invention by way of trial, and as a result, found out that deflection deformation of the holding member 102 was unignorable when rigidity of the holding member 102 was lower than that of the curving member 101. In this case, a state in which the pressure member 103 is positioned inside the contact portion 105 (hereinafter referred to as "inside configuration") results in the same state as the load applied to a both-end supporting beam. However, a state in which the pressure member 103 is positioned outside the contact portion 105 (hereinafter referred to as "outside configuration") results in the same state as the load applied to the cantilever with respect to the end portion of the holding member 102. Accordingly, the outside configuration has a larger amount of deflection than the inside configuration when an equivalent amount of bending moment is applied.

As shown in FIG. 6A, when deflection μ of the holding member 102 is large, deflection deformation of the curving member 101 and that of the holding member 102 are added up. As a result, when the amount of deformation is larger than a tip space S, the curving member 101 and the holding member 102 come in contact with each other at their tip end portions, causing a possibility that a desired curve shape may not be obtained. The tip space S is appropriately set in consideration of the rigidity and amount of deformation of each component, thereby allowing prevention of the contact between both members. However, regarding the reduction in attracting force due to narrowing of the pressure force acting distance by the amount corresponding to the deflection Δ as the pressure member 103 is moved away from the contact portion 105, the reduction in attracting force is larger in the outside configuration than in the inside configuration as mentioned above.

Here, FIG. 6B shows a relationship between moment M and length l from the contact portion 105 to the pressure member. When the pressure force acting distance is unchanged in the longitudinal direction of the holding member, the moment M is proportional to the length l from the contact portion 105 to the pressure member 103, and therefore the relationship between the moment M and length l up to the pressure member is shown by a dotted line in the figure from the relationship between the moment M and the contact portion. When the pressure force acting distance is increased as the pressure member 103 is moved away from the contact portion 105 in the longitudinal direction of the holding member, the relationship between the moment M and length l up to the pressure member is shown by a solid line in the figure from the relationship between the moment M and the contact portion, and it is possible to control the moment M based on the set pressure force acting distance.

If the pressure force acting distance at the outside of the contact portion 105 of the pressure member is set to be greater than that at the inside of the contact portion 105, thereby it is possible to cancel the reduction in attracting force generated by deflection deformation of the holding member 102 when the pressure member 103 is positioned outside the contact portion 105 and to approximately equalize the amount of curvature of the holding member with respect to the distance from the contact portion in both the outside configuration and the inside configuration.

The holding member 102 can be manufactured with any material and any method if it has sufficient strength and rigidity for practical use, and in particular, a member, which is formed by bending, drawing and cutting a metal plate, namely, a so-called sheet metal-made holding member can be simply manufactured at low cost by press molding.

Figure 7A:
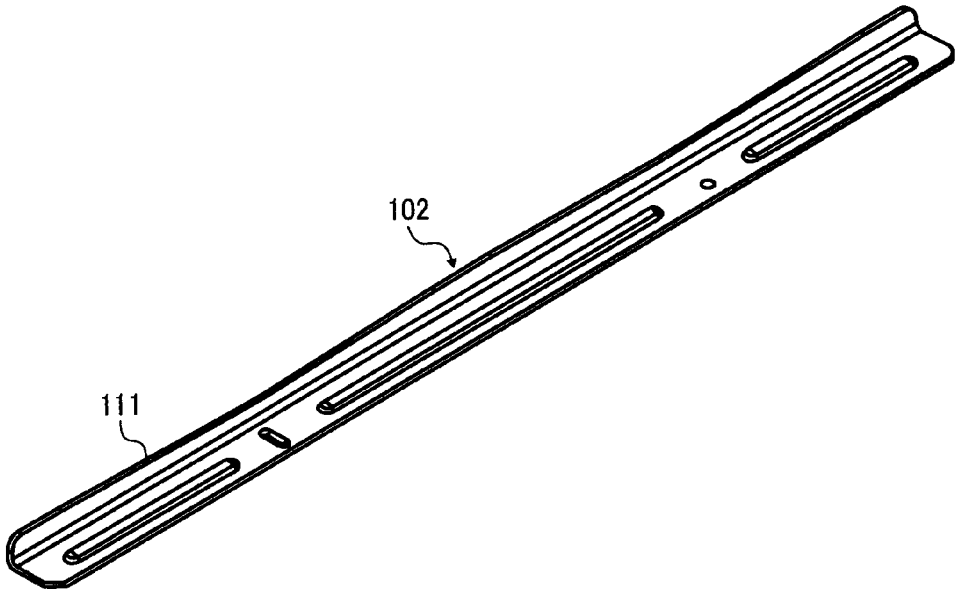
FIG. 7A is a perspective view showing a curved surface forming apparatus according to a fifth embodiment of the present invention.
Figure 7B:
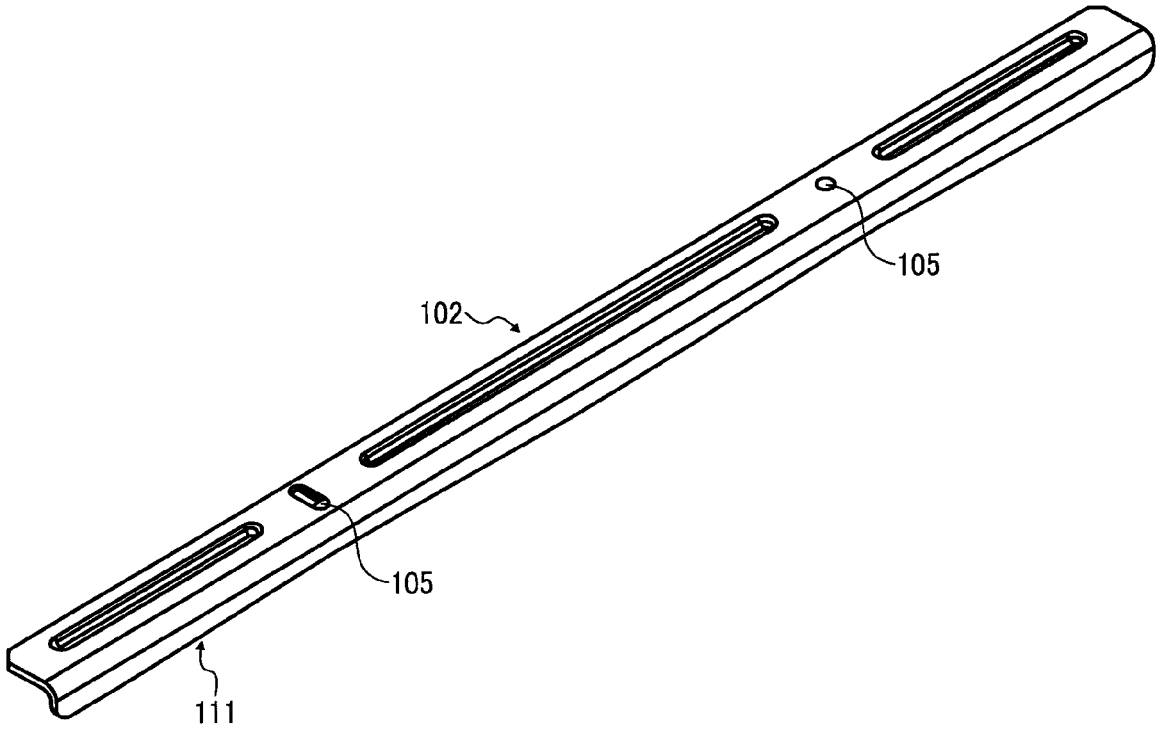
FIG. 7B is a perspective view showing the curved surface forming apparatus according to the fifth embodiment of the present invention.
Figure 7C:
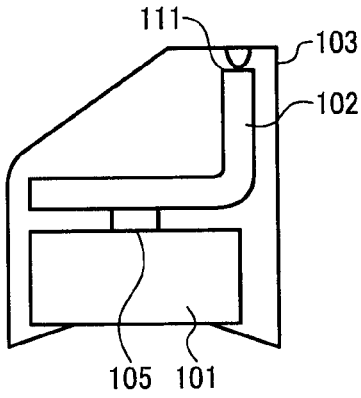
FIG. 7C is a cross sectional view of the curved surface forming apparatus according to the fifth embodiment of the present invention.

Each of FIGS. 7A, 7B and 7C shows a curved surface forming apparatus according to a fifth embodiment of the present invention. In this embodiment, the holding member 102 is formed of a sheet material and is bent to form a rising portion 111 at its one end in a width direction, and the rising portion 111 serves as a changing profile surface that changes a distance from the curving member 101, namely a pressure force acting distance. The curving member 101 comes in contact with multiple contact portions 105 (see FIG. 7B) formed on the holding member 102 to form a space between the curving member 101 and the holding member 102. The pressure member 103 holds the curving member 101 and the holding member 102 in such a form that the curving member 101 and the holding member 102 are encompassed (see FIG. 7C).

In this embodiment, the curving member 101 has a plane where a contact side surface being in contact with the holding member and a non-contact side surface being opposite to the contact side surface are parallel to each other, and the contact portion 105 comes in contact with the plane stably, so that the curving member 101 has a form of two-point supports separated in a longitudinal direction.

The rising portion 111 contributes to improvement of rigidity of the holding member 102 itself to make it possible to control deflection generated by the attracting force. In this embodiment, the rising portion 111 is formed only on one end of the holding member, but can be formed on both ends of the holding member. In this case, rigidity of the holding member 102 can be improved.

Figure 8A:
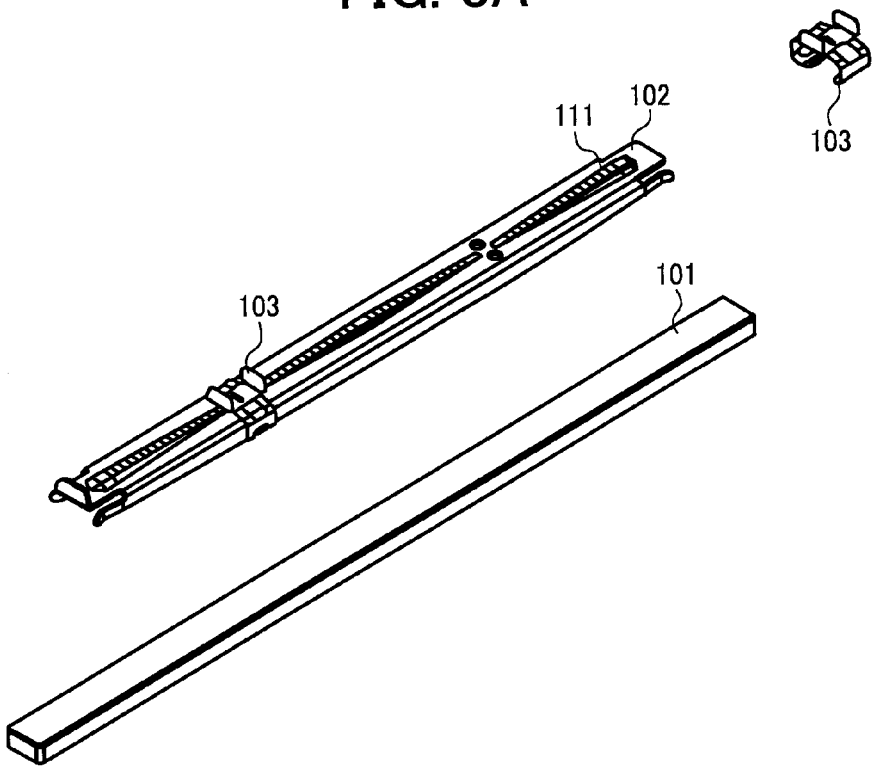
FIG. 8A is a perspective view showing a curved surface forming apparatus according to a sixth embodiment of the present invention.
Figure 8B:
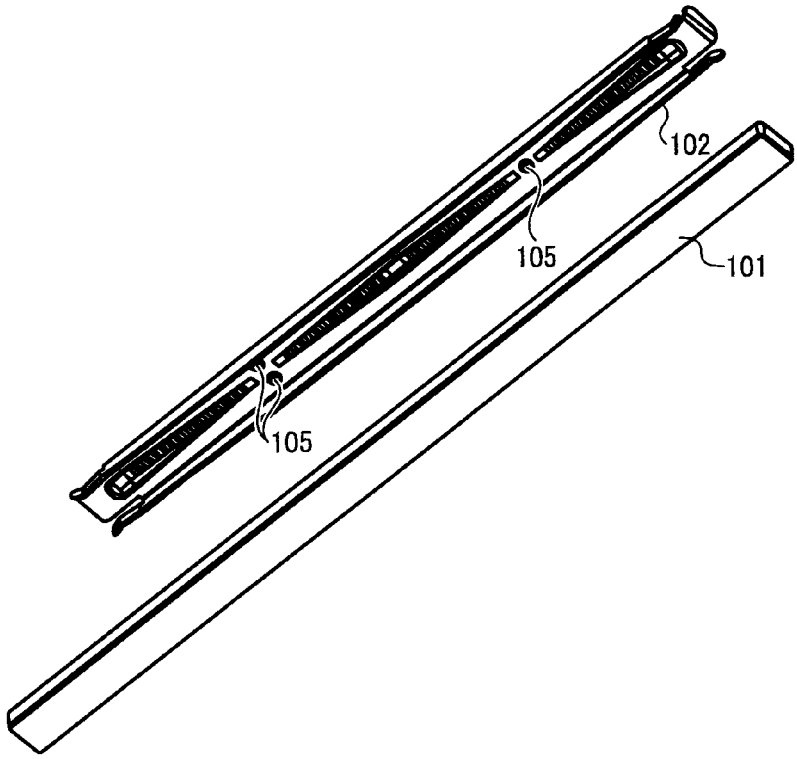
FIG. 8B is a perspective view showing the curved surface forming apparatus according to the sixth embodiment of the present invention.
Figure 8C:
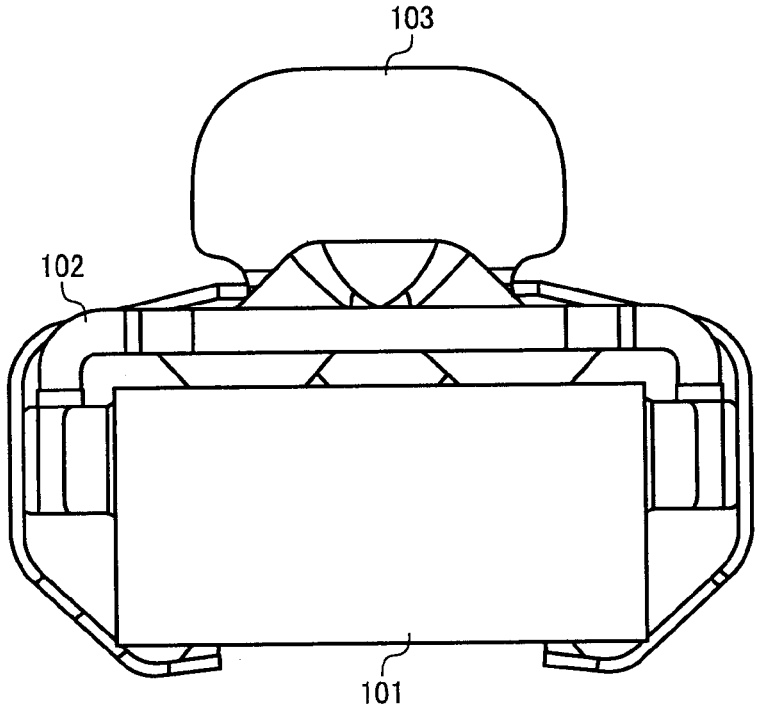
FIG. 8C is a side view showing the curved surface forming apparatus according to the sixth embodiment of the present invention.

Each of FIGS. 8A, 8B and 8C shows a curved surface forming apparatus according to a sixth embodiment of the present invention. More specifically, FIGS. 8A and 8B show that the changing profile surface 111 is formed on an upper surface of the holding member 102 by performing drawing on a part of the upper surface. FIG. 8C shows that the holding member 102 is bent in a squared U-shape at both ends in its width direction to encompass the curving member 101, and this structure further improves rigidity together with the changing profile surface 111 with drawing performed on.

Figure 9:
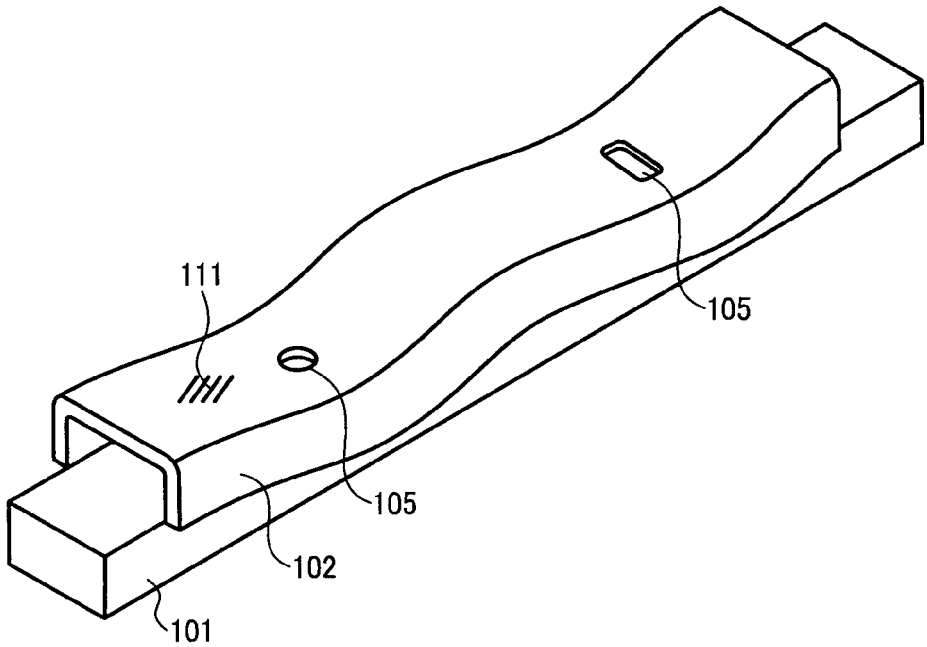
FIG. 9 is a perspective view showing a curved surface forming apparatus according to a seventh embodiment of the present invention.

FIG. 9 shows a curved surface forming apparatus according to a seventh embodiment of the present invention. More specifically, FIG. 9 shows a case in which the changing profile surface 111 is formed by bending the upper surface of the holding member 102 in a waveform in its longitudinal direction. The holding member 102 is bent in a squared U-shape at both ends in its width direction to encompass the curving member 101 to thereby improve rigidity. This shape can be easily formed by bending not only the sheet metal but also extruded material.

According to the aforementioned embodiment, in order to obtain a desired curvature of the curving member 101, after the curved surface forming apparatus is assembled, the position of the pressure member 103 is moved in the longitudinal direction of the curving member 101 to thereby allow adjustment of the amount of curvature of the curving member 101. If a desired curvature is mechanically fixed here, the pressure member can be positioned in advance at an appropriate position, but there are variations in the physical properties and sizes of the structural members such as a holding member and the like, and therefore there arises the need for adjusting attracting forces and bending moment by way of slightly moving the pressure member.

When the aforementioned changing profile surface 111 of the holding member 102 functions as a smoothing surface of the pressure member 103 and has a certain angle with respect to the attracting force of the pressure member, a component force of pressing force parallel to the profile surface, which is generated by the attracting force, acts on the pressure member. When the component force overcomes a static friction force at the profile contact surface, the pressure member slips off the profile surface causing the reduction of the attracting force and bending moment, and therefore a desired curvature cannot be formed on the curving member 101. In the actual structure, since the static friction force acts on the contact portion of the curving member 101 and the pressure member 103, the pressure member does not slip off in a normal static state. In addition, it is preferable that an adjustment notch or a so-called click feeling is given to the changing profile surface 111 from the viewpoint of improving workability in which the pressure member is easily stopped at a desired position when being moved for curvature adjustment and also from the viewpoint of reliability of being capable of coping with an impact, a change in temperature, etc. For example, the number of notches is counted in moving the multiple pressure members for substantially symmetrical adjustment of the curvature, so that adjustment becomes easy and the number of operation steps is reduced.

Figure 10A:
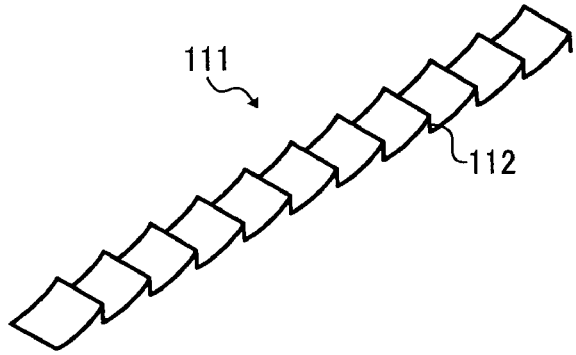
FIG. 10A is a perspective view showing an example of a changing profile surface in a curved surface forming apparatus according to an eighth embodiment of the present invention.
Figure 10B:
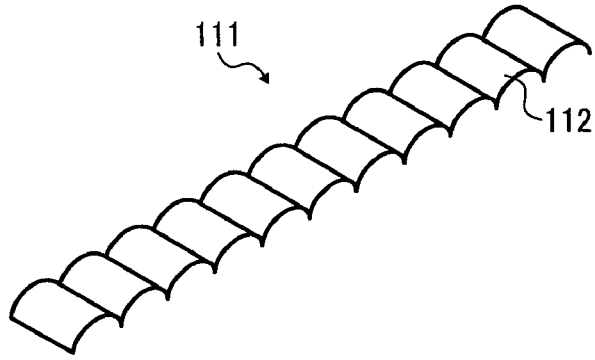
FIG. 10B is a perspective view showing another example of a changing profile surface in the curved surface forming apparatus according to the eighth embodiment of the present invention.
Figure 10C:
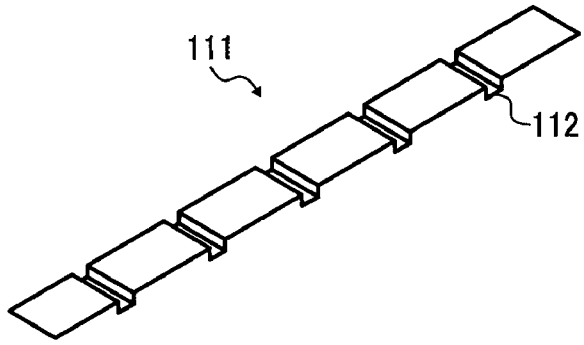
FIG. 10C is a perspective view showing a further example of a changing profile surface in the curved surface forming apparatus according to the eighth embodiment of the present invention.

Each of FIGS. 10A, 10B and 10C shows a curved surface forming apparatus according to an eighth embodiment of the present invention. More specifically, each of FIGS. 10A, 10B and 10C shows a modification of the changing profile surface in the curved surface forming apparatus.

FIG. 10A shows a changing profile surface having a saw-like engagement structure 112, FIG. 10B shows a changing profile surface having a semicylindrical engagement structure 112, and 10C shows a changing profile surface having a groove-like engagement structure 112. The changing profile surface has multiple profiles of stepwise engagement shapes, which makes it possible to wipe out the aforementioned fear, to reduce the number of operation steps, and to improve reliability.

The aforementioned shapes can be molded by a press die when the profiles are formed on the end surface of the sheet metal. However, a reduction in strength of the press die and complication of die machining sometimes cause an increase in cost. Contrary to this, as shown in FIGS. 8A and 8B, the engagement shape is formed by drawing to thereby make it possible to obtain a desired engagement shape while avoiding an increase in the cost of the die.

Figure 11A:
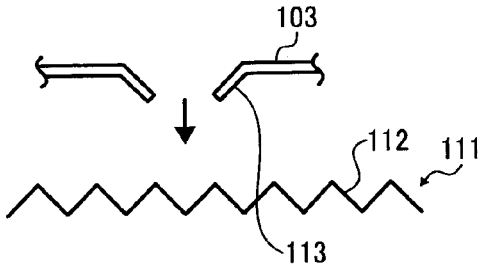
FIG. 11A is an explanatory view of the curved surface forming apparatus according to a modification of the eighth embodiment of the present invention.
Figure 11B:
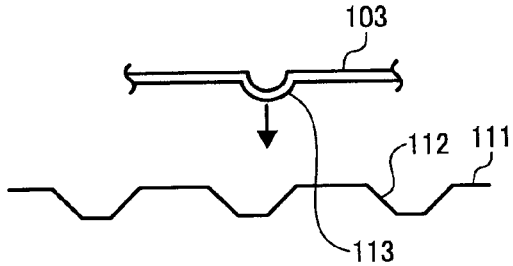
FIG. 11B is an explanatory view of the curved surface forming apparatus according to a modification of the eighth embodiment of the present invention.

FIGS. 11A and 11B show modifications of the changing profile surfaces shown in FIGS. 10A and 10B and the pressure members to be engaged with these changing profile surfaces. In FIG. 1A, the changing profile surface 111 has multiple triangular projections 112, and an engaging portion 113 is formed by bending the pressure member 103 to be engaged with each projection. In FIG. 11B, the changing profile surface 111 has multiple mountain shapes, and an engaging portion 113 having a substantially semicircular cross section is formed on the pressure member 103. It is preferable that the both the changing profile surface 111 and the engagement portion 113 are formed by drawing.

As mentioned above, the engagement portion 113 of the pressure member 103 and the changing profile surface of the holding member 102 are formed by drawing, respectively, thereby being capable of obtaining a smooth operation of the pressure member and the click feeling thereof while improving the rigidity of the pressure member 103 and the holding member 102.

It is preferable that an elastic material, or desirably a spring plate material is formed as a pressure member. If the pressure member is the elastic material, it is possible to obtain a stable attracting force even when the pressure member is moved to change the attracting force. The elastic material includes rubber, elastomer, metal having a spring property and the like, but it is possible to form the engaging portion by the aforementioned drawing from the viewpoint of the degree of freedom of shape, the amount of attracting force, aging and environment reliability, a processing cost, and the like.

Figure 12A:
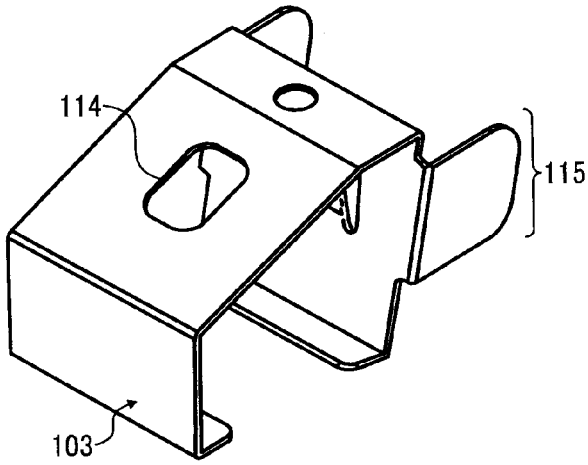
FIG. 12A is a perspective view showing one specific form of a pressure member in a curved surface forming apparatus according to a ninth embodiment of the present invention.
Figure 12B:
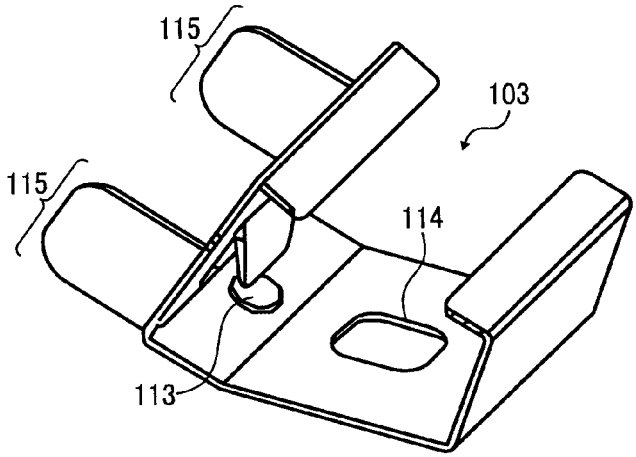
FIG. 12B is a perspective view showing one specific form of the pressure member in the curved surface forming apparatus according to the ninth embodiment of the present invention.

Each of FIGS. 12A and 12B shows a curved surface forming apparatus according to a ninth embodiment of the present invention. More specifically, FIGS. 12A and 12B show one embodiment of the pressure member in the curved surface forming apparatus according to the present invention.

The pressure member 103 is formed by pressing a spring plate material, and has a convex engaging portion 113 drawn to a suitable shape to come in contact with the profile surface of the holding member 102 at the time of adjusting the position (see FIG. 12B). The height of the convex engaging portion 113 is suitably set to thereby prohibit an edge of the press part from coming in contact with the curving member 101 even when the inclination of the pressure member is generated as mentioned above, and therefore the contact portion 105 of the holding member can stably come in contact with the curving member 101 regardless of the change in attracting force, and good workability of the moving adjustment of the pressure member 103 can be achieved.

Moreover, a hole 114 is formed on the pressure member. The hole 114 is formed to have a size such that the attracting force satisfies a given magnitude and such that an optional tool (not shown) can be inserted thereinto when the pressure member is moved, to be adjusted, in the longitudinal direction with respect to the holding member. By forming the hole 114, the optional tool such as an adjustment jig or the like is used to be engaged with the hole 114 to allow adjustment of movement of the pressure member, thereby making it possible to easily execute adjustment work. This can be applied to a case in which the pressure member and the holding member are, for example, molded plastic products instead of pressed products. Moreover, the shape, size, and depth of the hole are not limited as long as permitted by the tool to be inserted.

Furthermore, in the present embodiment, there are formed, for example, two projections 115 that can be held by a fingertip or tool. By this means, it is possible to improve rigidity of the pressure member itself and adjust movement of the pressure member by holding the projections 115 with the fingertip without any tool to be engaged with the hole 114 and to make pressure member handling performance suitable. Moreover, the pressure member in this embodiment is formed to be symmetric with respect to the longitudinal direction of the holding member in the assembled curved surface forming apparatus.

This makes it possible to assemble the pressure member without having locality with respect to the multiple contact portions and without specifying the position where the pressure member is assembled (hereinafter, referred to as the assembling position), and thus the number of assembly steps and the manufacturing cost are reduced.

Figure 13A:
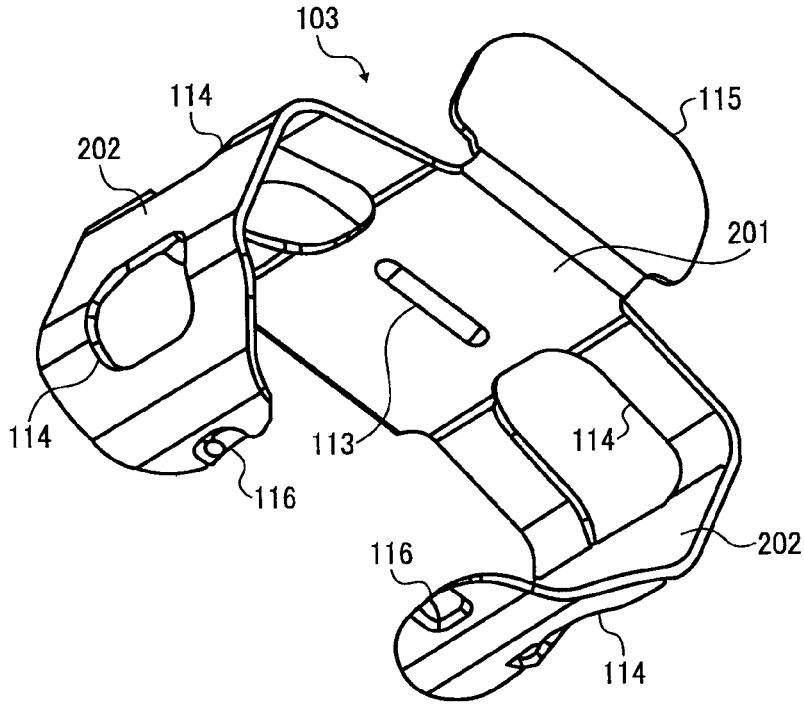
FIG. 13A is a perspective view showing another specific form of the pressure member in the curved surface forming apparatus according to a modification of the ninth embodiment of the present invention.
Figure 13B:
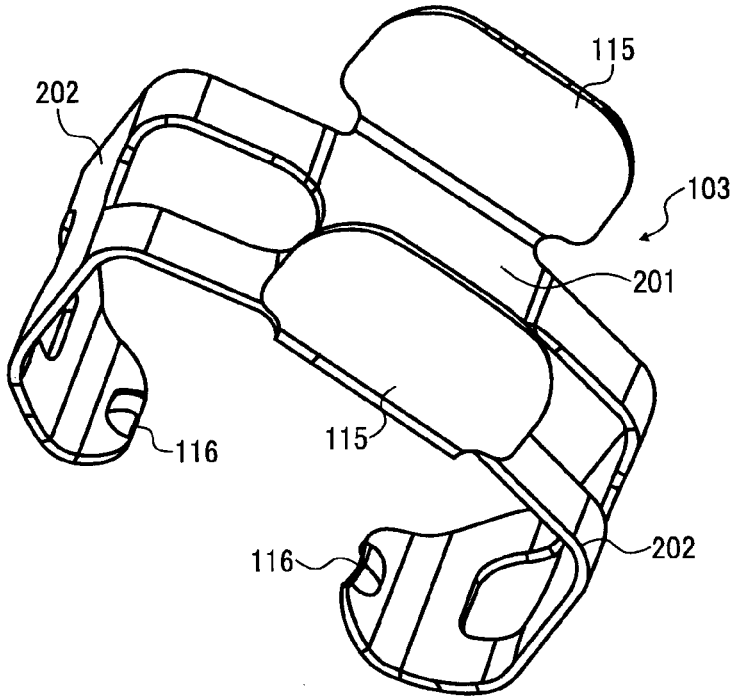
FIG. 13B is a perspective view showing another specific form of the pressure member in the curved surface forming apparatus according to a modification of the ninth embodiment of the present invention.

FIGS. 13A and 13B show modifications of the pressure members shown in FIGS. 12A and 12B, respectively. In this embodiment, the pressure member 103 is symmetrically formed. In other words, the pressure member 103 has an upper portion 201 and side portions 202 extending to both sides from the upper portion. On these side portions 202, there are formed multiple holes 114 into which the tool is inserted. The holdable projection 115 is formed on an outer surface of the upper portion. The side portions 202 are arranged to encompass the curving member 101 and the holding member 102.

The pressure member 103 in this embodiment is formed to be symmetric with respect to the longitudinal direction of the holding member in the assembled curved surface forming apparatus, and therefore it is possible to assemble the pressure member without having locality with respect to the curving member 101 and the holding member 102 and without specifying the assembling position and direction of the pressure member, and thus the number of assembly steps and the manufacturing cost are further reduced.

In the embodiment shown in FIGS. 13A and 13B, convex shapes 116 are formed by drawing on the side portions 202 of the pressure member 103 such that the pressure member 103 and the curving member 101 come in substantially point contact with each other. The height of these convex shapes 116 are suitably set to thereby prohibit an edge of the press part from coming in contact with the curving member even when the inclination of the pressure member is generated as mentioned above, and therefore the contact portion of the holding member can stably come in contact with the curving member regardless of the change in attracting force, and good workability of the moving adjustment of the pressure member can be achieved, and partial damage on the contact portion of the curving member can be prevented. Also, regarding the engaging portion, the height is suitably set to thereby prohibit an edge of the press part from coming in contact with the curving member even when the inclination of the pressure member as mentioned above, and therefore the contact portion of the holding member can stably come in contact with the curving member regardless of the change in attracting force and good workability of the moving adjustment of the pressure member can be achieved.

Each of FIGS. 14A to 14D shows a curved surface forming apparatus according to a tenth embodiment of the present invention. The curved surface forming apparatus in this embodiment is structured by combining the holding member 102 similar to that shown in FIGS. 8A and 8B, two pressure members 103 shown in FIGS. 13A and 13B, and the uniaxially elongated cubic curving member 101. In this embodiment, the pressure member 103 is placed on the contact portion 105 shown in FIG. 8B (not shown in FIGS. 14A and 14B) and is moved in the longitudinal direction of the curving member 101 to thereby adjust the amount of curvature.

The curving member 101 comes in contact with the holding member 102 at two contact portions 105 and an attracting force are applied thereto by two pressure members 103 having the same structure, and the holding member 102 holds the curving member 101 in a two-point supporting beam state.

Figure 14A:
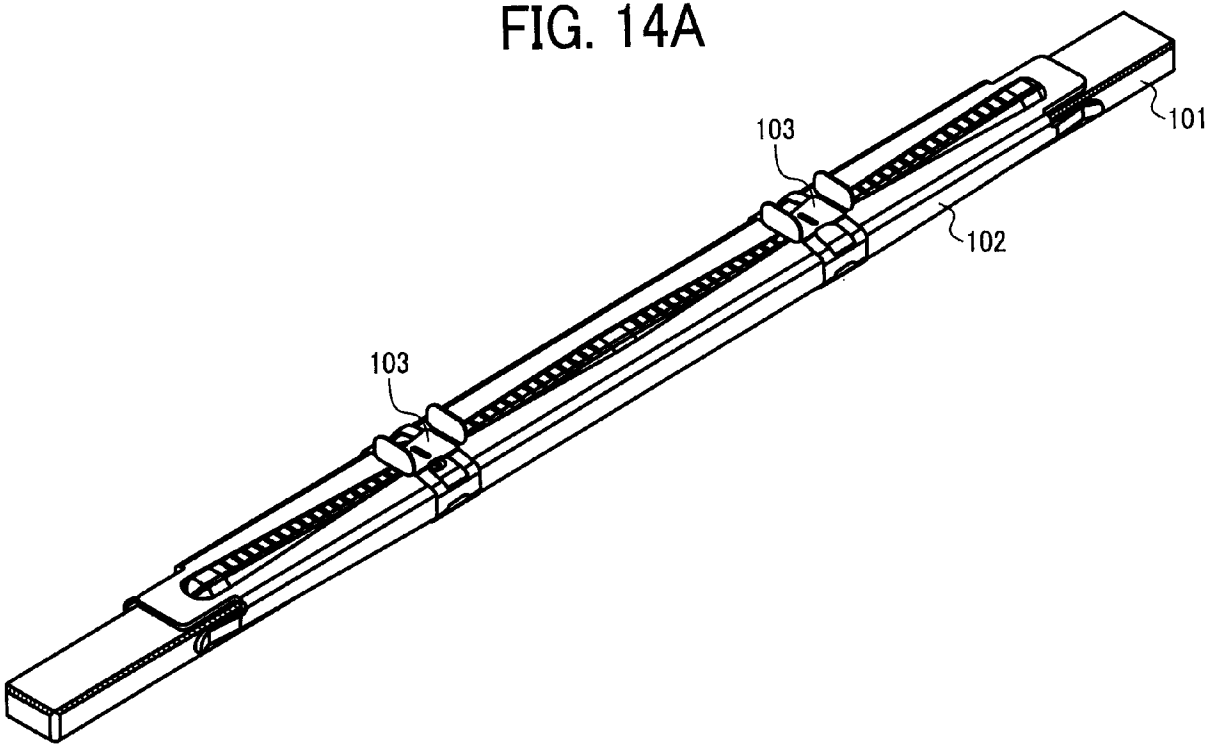
FIG. 14A is a perspective view showing a curved surface forming apparatus according to a tenth embodiment of the present invention.
Figure 14B:
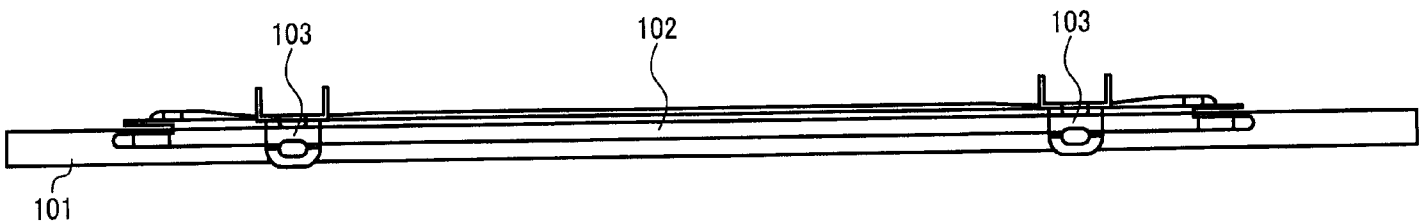
FIG. 14B is a front view showing the curved surface forming apparatus according to the tenth embodiment of the present invention.

In FIG. 14B, the pressure member 103 is placed just above the contact portion 105, and therefore the attracting force acts on the curving member 101 and the holding member 102 through the contact portion 105, however, no bending moment about the contact portion 105 is generated and no curvature deformation occurs on the curving member 101 and the holding member 102.

Figure 14C:
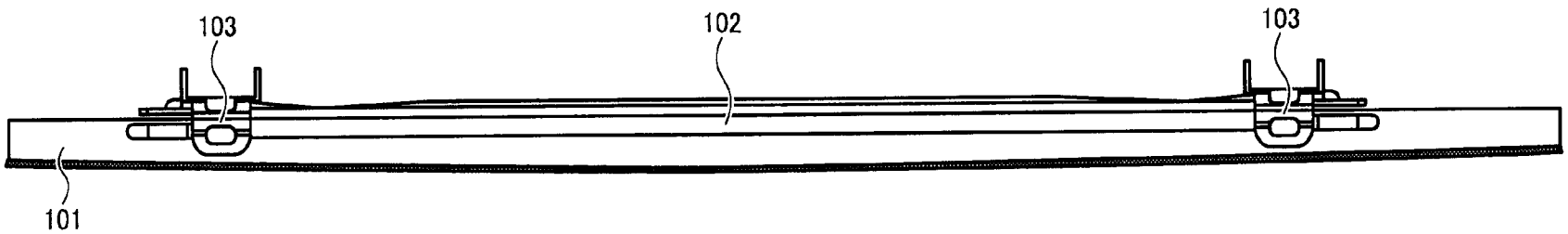
FIG. 14C is a front view showing the curved surface forming apparatus according to the tenth embodiment of the present invention.

In FIG. 14C, the pressure members 103 are positioned outside the contact portions 105, and therefore bending moment about the contact portion 105 is generated and a minute downward convex deflection 61 is caused on the curving member 101 as shown in the figure. At this time, the curving member 101 has a continuous curvature, however, correctly speaking; a surface of the curving member 101 is not an even curved surface but a continuous surface having a suspended plane that gradually changes.

Figure 14D:
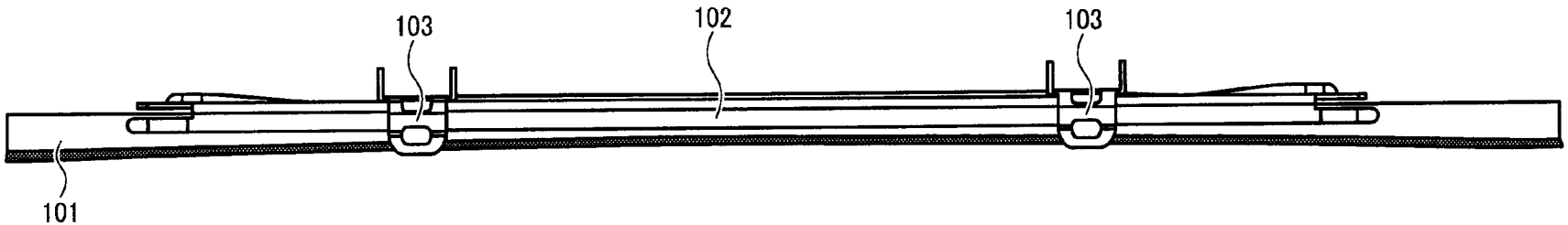
FIG. 14D is a front view showing a state in which a pressure member is moved in the curved surface forming apparatus according to the tenth embodiment of the present invention.

In FIG. 14D, the pressure members 103 are positioned inside the contact portions 105, and therefore bending moment about the contact portion 105 is generated and a minute downward concave deflection $-\delta_2$ is caused on the curving member 101 as shown in the figure. At this time, the curving member 101 has a continuous curvature; however, correctly speaking; a surface of the curving member 101 is not an even curved surface but a continuous surface having a suspended plane that gradually changes. Particularly, no bending moment is generated outside the contact portions 105 except the bending moment by self weight of the curving member 101, and only an inclination with respect to the longitudinal direction of the curving member 101 is changed to be directed inwardly at its both ends.

As mentioned above, according to the aforementioned embodiment, the positions of the pressure members 103 are changed with respective to the contact portions 105, thereby making it possible to change the amount of curvature of the curving member 101 and the concave and convex curvature directions.

The pressure member 103 or holding member 102 is formed to be symmetric with respect to the longitudinal direction and the width direction. This makes it possible to assemble the pressure member 103 and the holding member 102 without having directivity with respect to the curving member 101 and without specifying the assembling position and direction, and thus the number of assembly steps and the manufacturing cost are further reduced.

As mentioned above, the curvature shape of the curving member 101 is decided by the position of the pressure member and the application of bending moment generated by the attracting force at the position. In the case of two pressure members being arranged symmetrically with respect to two contact portions and having the same structure, distances from the respective contact portions are made equal to each other, thereby making it possible to provide the curved state with symmetry maintained using the center in the longitudinal direction as a symmetry axis between the contact portions, which can be called the supporting points when the curving member is regarded as a beam. Likewise, regarding the moving adjustment of the pressure members, the pressure members are moved with symmetry maintained, thereby making it possible to change adjustment of the pressure members to achieve the curved state with symmetry maintained.

The following will explain an application example of the curved surface forming apparatus.

Figure 19:
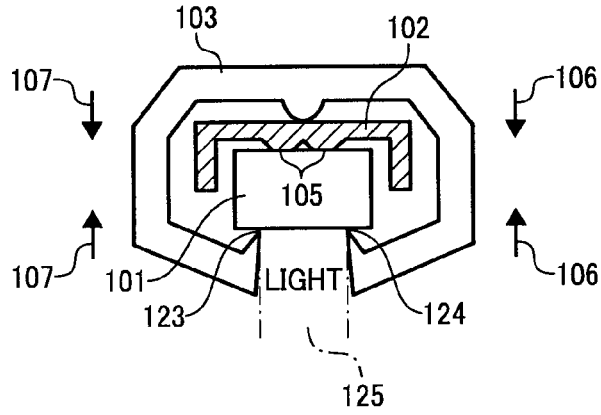
FIG. 19 is a schematic view showing a state in which the pressure member occupies a position where an attracting force reaches the maximum in one embodiment.
Figure 20:
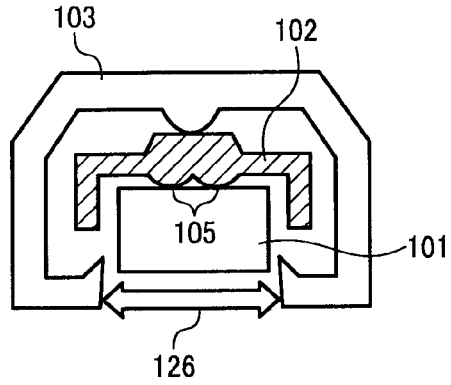
FIG. 20 is a schematic view showing a state in which the pressure member occupies a position where an attracting force reaches the maximum in one embodiment.
Figure 21:
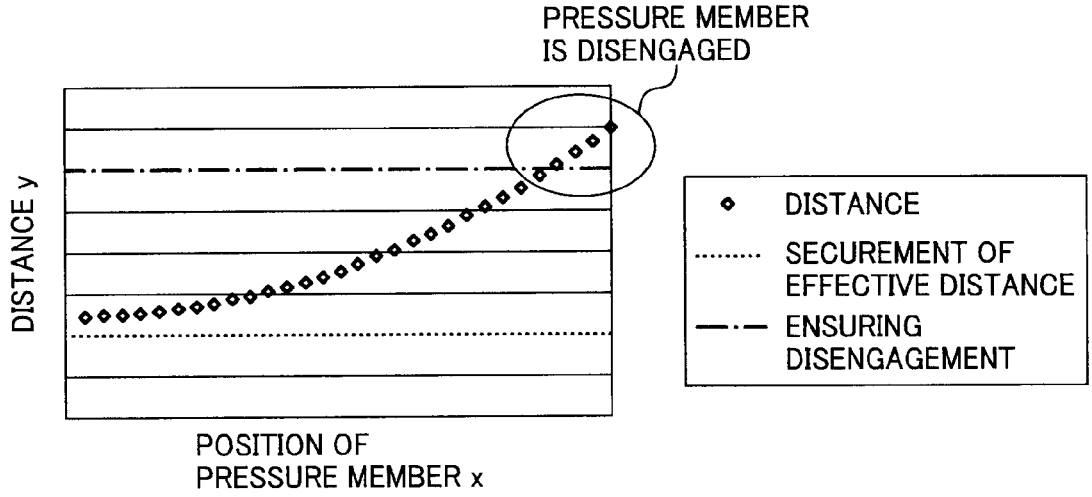
FIG. 21 is a diagram showing a correlation among a change in distance between side portions of the pressure member, the amount of light irradiation and a pressurized state of the pressure member in one embodiment.

FIG. 19 shows a case in which the pressure member 103 is positioned on the contact portion 105 of the holding member 102 to minimize attracting forces 106 and 107, and contact points 123 and 124 between the pressure member 103 and an optical mirror 101 (a curving member) are placed at a limit position where incidence of light 125 on the optical mirror 101 is not blocked. When the pressure member 103 occupies a position where the pressure member 103 is moved to change the amount of deflection of the optical mirror 101 from this state to maximize the attracting forces 106 and 107, the pressure member 103 is deformed to increase a distance 126 between the contact points 123 and 124 as the attracting forces 106 and 107 are increased, with the result that the pressure member 103 is disengaged from the optical mirror 101 as shown in FIG. 20. FIG. 21 shows a correlation among the change in distance 126, the amount of irradiation of light 125, and an enclosing state of the pressure member 103 at this time.

Figure 22:
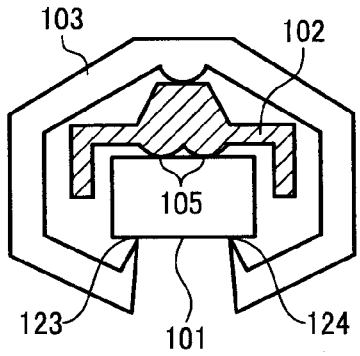
FIG. 22 is a schematic view showing a state in which the pressure member occupies a position where an attracting force reaches the maximum in another embodiment.
Figure 24:
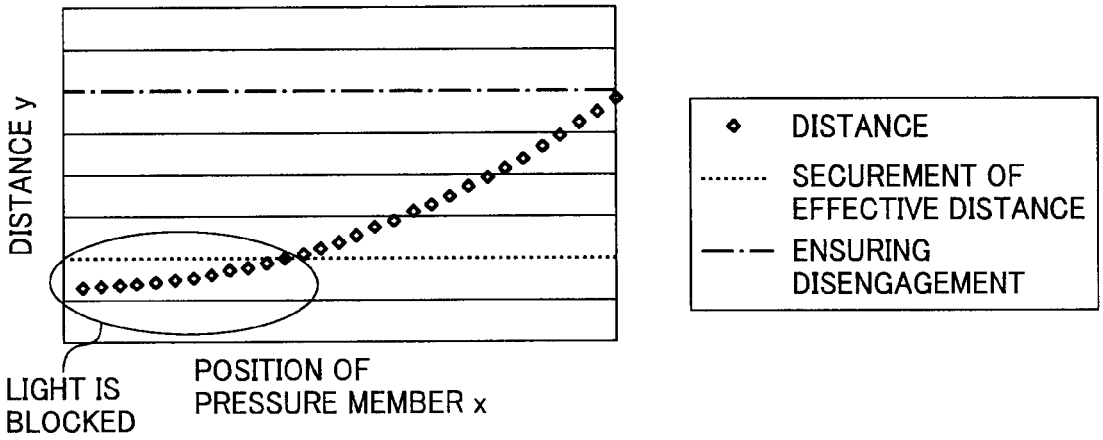
FIG. 24 is a diagram showing a correlation among a change in distance between side portions of the pressure member, the amount of light irradiation and a pressurized state of the pressure member in another embodiment.

FIG. 22 shows a case in which the pressure member 103 occupies a position where the attracting forces 106 and 107 reach the maximum and the pressure member 103 is placed at a limit position where the pressure member 103 can encompass the optical mirror 101 and the holding member 102. When the pressure member 103 occupies a position where the pressure member 103 is moved to change the amount of deflection of the optical mirror 101 from this state to minimize the attracting forces 106 and 107, the pressure member 103 is deformed to decrease the distance 126 between the contact points 123 and 124 as the attracting forces 106 and 107 are decreased, with the result that the space 126 reaches the minimum and incidence of the light 125 on the optical mirror 101 is blocked by the contact points 123 and 124. FIG. 24 shows a correlation among the change in distance 126, the amount of irradiation of light 125 and an enclosing state of the pressure member 103 at this time.

Figure 23:
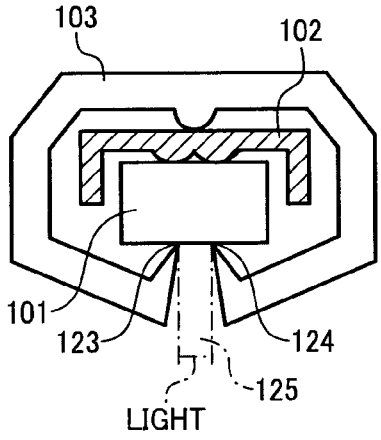
FIG. 23 is a schematic view showing a state in which the pressure member occupies a position where an attracting force reaches the maximum in another embodiment.
Figure 25:
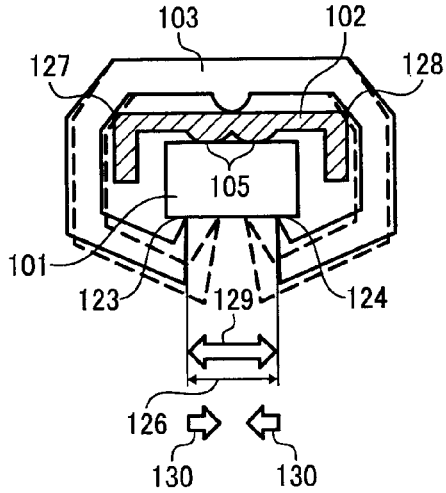
FIG. 25 is a schematic view showing a state in which the pressure member occupies a position where an attracting force reaches the maximum in further another embodiment.

In order to solve the aforementioned problems, as a modification of the tenth embodiment of the present invention, in the case where the pressure member 103 is positioned on the contact portion 105 of the holding member 102 to minimize the attracting forces 106 and 107 and the pressure member 103 is placed at a limit position where the pressure member 103 can encompass the optical mirror 101 and the holding member 102 as shown in FIG. 25. At contact points 127 and 128, the pressure member 103 is structured to come in contact with an edge portion of the holding member 102 placed on the side where no contact with the optical mirror 101 is made. The pressure member 103 is deformed by this contact to make it possible to ensure the space 126 that does not block incidence of light 125 on the optical mirror 101 as shown by a broken line in FIG. 25 as compared with the case in which there is no contact by way of contact points 127 and 128 as shown in FIG. 23.

Figure 26:
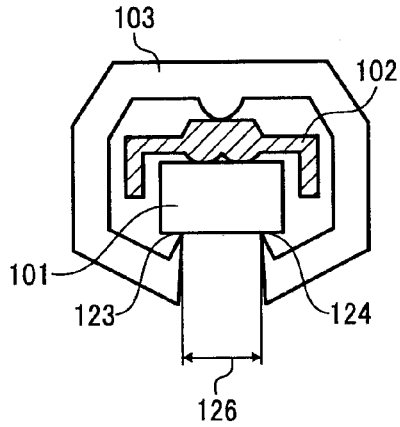
FIG. 26 is a schematic view showing a state in which the pressure member occupies a position where an attracting force reaches the maximum in further another embodiment.
Figure 27:
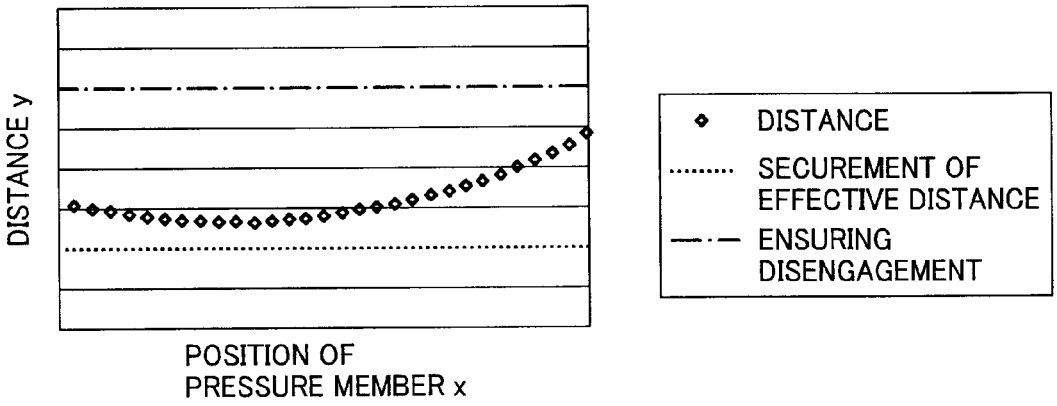
FIG. 27 is a diagram showing a correlation among a change in distance between side portions of the pressure member, the amount of light irradiation and a pressurized state of the pressure member in another embodiment.

Moreover, when the pressure member 103 is moved from the position shown in FIG. 25 to the position where the attracting forces 106 and 107 reach the maximum, a contact force of the pressure member 103 to the holding member 102 at the contact points 127 and 128 is decreased gradually eventually a non-contact state is created as shown in FIG. 26. During the movement, the space 126 has both deformation 129, which tends to expand with an increase in attracting forces 106 and 107, and deformation 130 which tends to narrow with a decrease in contact force between the pressure member 103 and the holding member 102. These deformations 129 and 130 are decided according to the shape of the pressure member 103 and that of the holding member 102, thereby making it possible to prevent the pressure member 103 from being disengaged from the optical mirror 101 and, at the same time, to prevent the pressure member 103 from entering the using range of the optical mirror 101 to block the light 125. FIG. 27 shows a correlation among the change in distance 126, the amount of irradiation of light 125 and an enclosing state of the pressure member 103 at this time.

The aforementioned structure makes it possible to bend the optical mirror 101 with a simple structure and a saved space by a desired amount, and at the same time prevent occurrence of faults such as disengagement due to deformation of the optical mirror 101 and blockage of light.

Figure 15A:
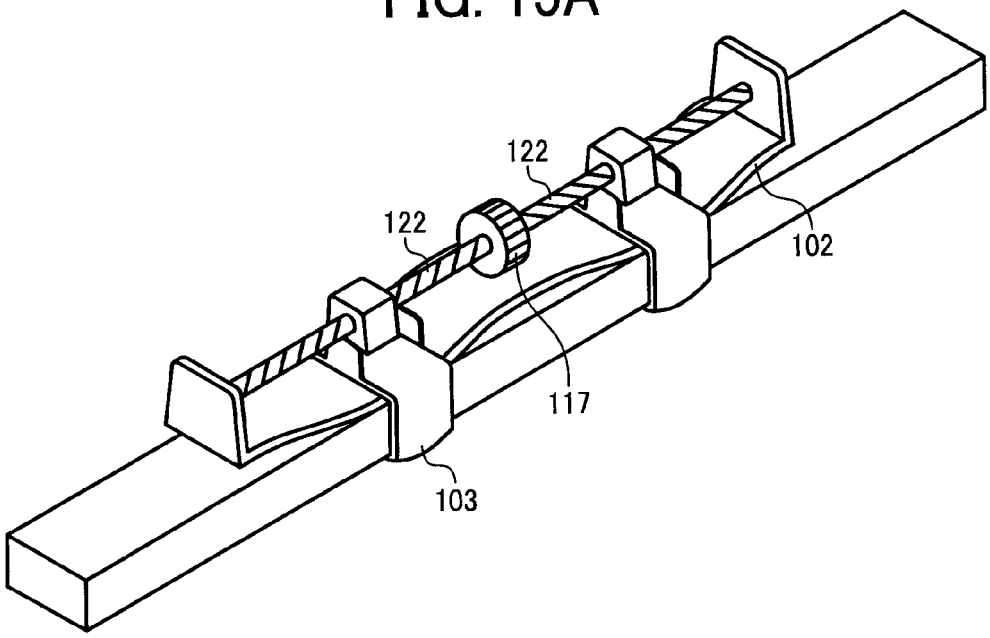
FIG. 15A is a perspective view showing a curved surface forming apparatus according to an eleventh embodiment of the present invention.
Figure 15B:
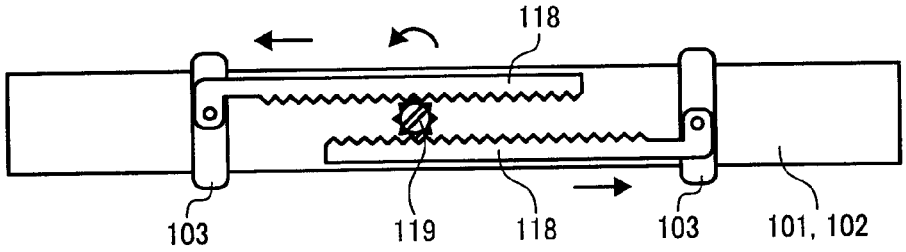
FIG. 15B is a plane view showing a curved surface forming apparatus according to a twelfth embodiment of the present invention.
Figure 15C:
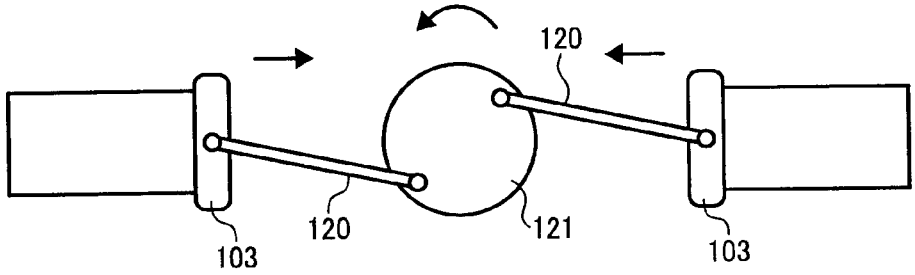
FIG. 15C is a plane view showing a curved surface forming apparatus according to a thirteenth embodiment of the present invention.

FIGS. 15A, 15B and 15C show curved surface forming apparatus according to eleventh, twelfth, and thirteenth embodiments of the present invention, respectively.

FIG. 15A is an example of screw type pressure members. A pair of pressure members 103 is combined with an opposing screw thread rod 122, which is provided integrally with the holding member 102 and which is rotatable around an axis. The screw thread rod 122 is provided such that a rotation knob 117 is placed at a center and rod screws on both sides are used as reverse screws with an equal pitch therebetween. When the rotation knob 117 is rotated in a certain direction, the pressure members 103 come close to each other with an equal distance or go away from each other with an equal distance.

FIG. 15B is an example of rack-pinion type pressure members. The pair of pressure members 103 is combined with racks 118, which are slidable only in the longitudinal direction of the holding member 102. The opposing racks 118 are meshed with a pinion 119 integrally attached to the holding member 102. When the pinion 119 is rotated in a certain direction, the pressure members 103 come close to each other with an equal distance or go away from each other with an equal distance.

FIG. 15C is an example of crank type pressure members. The pair of pressure members 103 is combined with rods 120. The opposing rods 120 are engaged with a crank shaft 121 integrally attached to the holding member 102. When the crank shaft 121 is rotated in a certain direction, the pressure members 103 come close to each other with an equal distance or go away from each other with an equal distance.

The addition of the aforementioned moving adjustment structure enables to maintain the positional relationship between the supporting point and the pressure member to make the curved shape of the curving member substantially symmetrical.

In one embodiment, the moving adjustment structure is supported by the holding member 102, however, the structure itself can be supported separately from the structure of the curved surface forming apparatus according to the present invention, and this can be a tool, which is finally detached after completion of adjustment.

In addition, the inventor of the present invention produced the curved surface forming apparatus according to the present invention by way of trial, and as a result, workability of moving adjustment of the pressure members deteriorated or the contact portion of the curving member was damaged due to the pressure members. The following cause can be considered:

The contact portion of the pressure member and the curved member is a stable contact due to line contact in principle. However, when the pressure member is slid with respect to the curving member for deformation adjustment, extending deformation of the holding member or the curving member is caused, so that the pressure member is inclined toward the curving member and comes in line or point contact with the curving member. In the case of the above embodiment, the edge of the press part comes in contact with the curving member, and the attracting force is applied thereto when the contact area reaches the minimum, so that contact pressure is increased and deterioration in workability of moving adjustment of the pressure members is caused in the adjusting area where the attracting force is increased.

By the curved surface forming apparatus having the aforementioned structure, it is possible to hold the curving member in a good curved condition. When the curving member is an optical mirror, it is possible to obtain an optical mirror having a curved state. By this curved surface forming apparatus, it is possible to obtain a substantially cylindrical convex or concave mirror, which is useful for various types of optical apparatus, from a general plane mirror easily with a low cost. General materials such as glass, metal, an inorganic substance, and an organic substance can be used as a material of the optical mirror. In the embodiments described so far, it is preferable that a surface on a side where contact with the holding member is made, namely, a surface opposing to the surface in contact with the holding member is formed as a mirror surface, but the present invention is not limited to this and the surface is selected depending on the usage.

An explanation will be next given of one embodiment of an optical apparatus according to the present invention. The curving member as mentioned above is not limited to the optical mirror, and even if optical elements such as a glass plate, a filter plate, a long lens, etc. are used as the curving member, this structure can be applied. By incorporating the curving member into optical apparatus of various types, it is possible to improve a value of the optical apparatus with a minute curvature obtained by the present curved surface forming apparatus.

An explanation will be next given of one embodiment of an optical scanning apparatus according to the present invention. Moreover, if the optical scanning apparatus is constructed with this optical apparatus, it is possible to efficiently use a minute curved surface obtained by the curved surface forming apparatus of the present invention.

In the optical scanning apparatus, the aforementioned curved surface forming apparatus is placed on a deflected scanning optical path to thereby adjust a scanning line curvature. In this case, addition of only a simple and low-cost structure makes it possible to adjust the scanning line curvature with high preciseness and improve a value of the optical scanning apparatus.

Moreover, in the optical scanning apparatus, a plurality of light sources and a plurality of curved surface forming apparatus of (the number of light sources—1) placed on a deflected scanning optical path are provided to thereby adjust shift between scanned lines caused by a relative difference in the curvature of scanning lines. In this case, addition of only a simple and low-cost structure makes it possible to adjust shift between scanned positions of drawn lines formed by a plurality of light beams and improve a value of the optical scanning apparatus.

Figure 16:
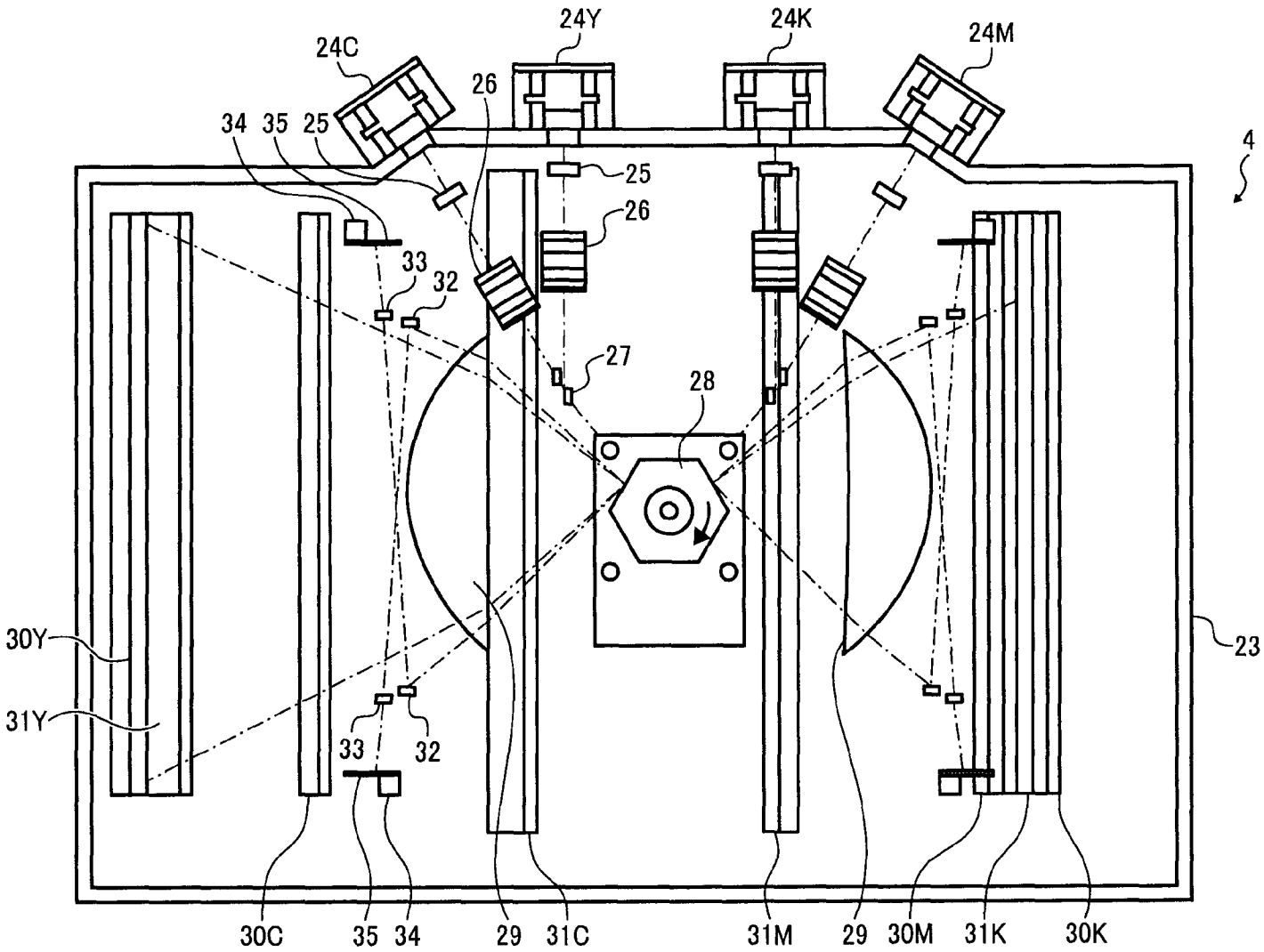
FIG. 16 is a plane view of one embodiment of an optical scanning apparatus according to the present invention.
Figure 17:
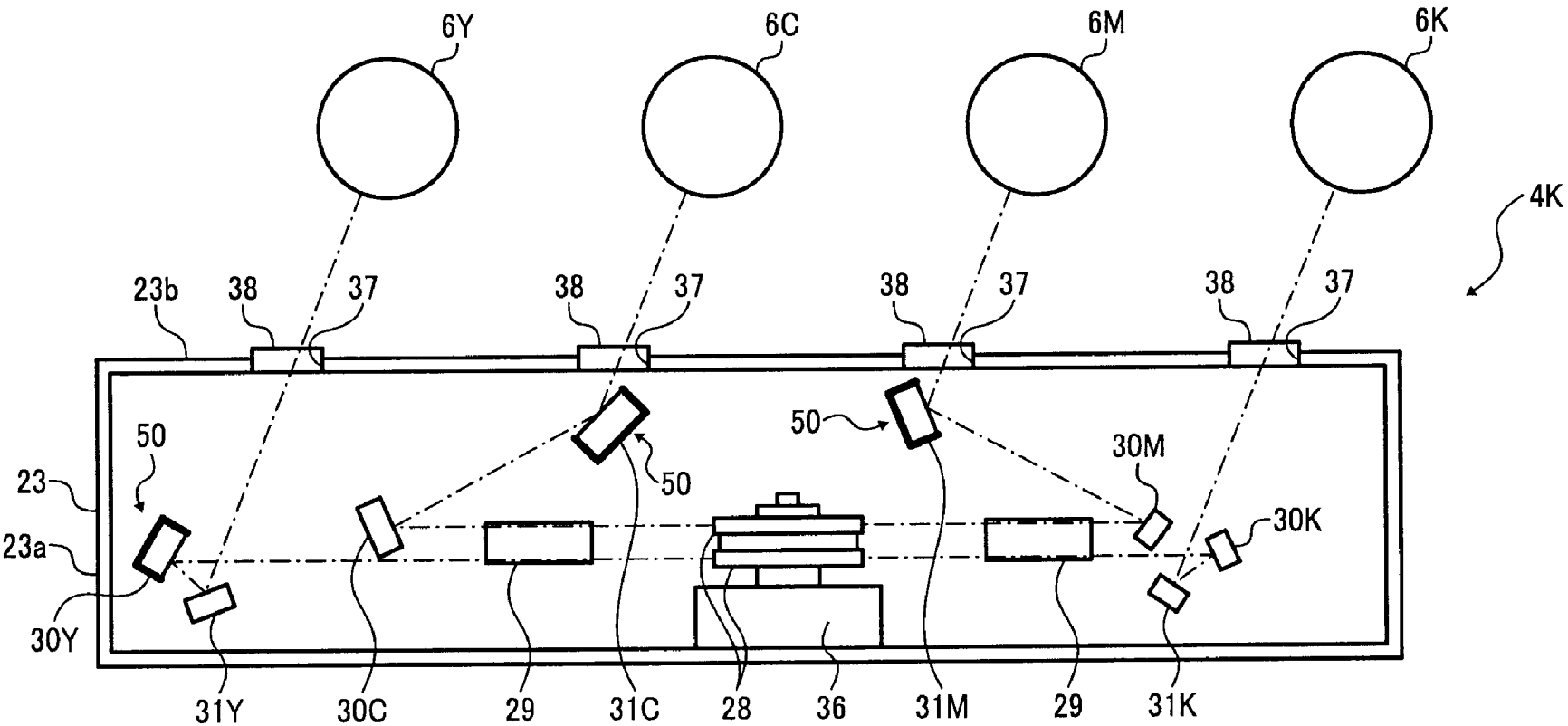
FIG. 17 is an elevation view of the optical scanning apparatus according to the present invention.

Each of FIGS. 16 and 17 shows one example of the optical scanning apparatus. More specifically, FIG. 16 shows an internal structure of an optical writing apparatus. Also, FIG. 17 is a vertical cross-sectional view of the optical writing apparatus.

An explanation will be next given of an optical writing apparatus 4. The optical writing apparatus includes an optical housing 23. In the optical housing 23, light sources 24 (24Y, 24C, 24M, 24K), which are light sources for emitting light beams (laser beams) according to image data of different colors (Y, C, M, K), respectively, and various types of optical members for irradiating photoreceptors 6 with scanning lines formed by the light beams are housed. The optical members housed in the optical housing 23 include apertures 25 for correcting a surface inclination, cylinder lenses 26, a mirror 27, a polygon mirror 28, focusing lenses 29, reflecting mirrors 30, 31 (30Y, 31Y, 30C, 31C, 30M, 31M, 30K, 31K), synchronization detection mirrors 32, focusing lenses 33, a photoelectric element 35 mounted on a circuit substrate 34, and the like. The light sources 24 are composed of a semiconductor laser, which emits a divergent light, a collimator lens for substantially parallelizing divergent light emitted from the semiconductor laser, a substrate for a semiconductor laser drive circuit, and the like.

The polygon mirror 28 is connected to a polygon motor 36 and rotates at high speed. The polygon mirror 28 rotates at various speeds, e.g., over 30000 rpm.

In a color printer 1, image data input from an original reader (scanner) or an image data output apparatus (a personal computer, a word processor, a receiving section of a facsimile apparatus, etc.) is color-separated. Image data of each color subjected to color separation is converted to a signal by which each light source 24 is driven, and a light beam is emitted from each light source 24 according to the signal. The light beams emitted from the light sources 24 reach the polygon mirror 28 through the aperture 25 for correcting a surface inclination and the cylinder lens 26, and are deflected and scanned into two light beams each for two symmetrical directions by the polygon mirror 28.

The light beams deflected and scanned in two symmetrical directions pass through the focusing lens 29, and are reflected by two types of reflecting mirrors 30 and 31 and travel towards the photoreceptors 6 of each of the printer engines 3. Then, an outer peripheral surface of each photoreceptor 6 is irradiated with the light beam traveled toward each photoreceptor 6, with the result that an electrostatic latent image is written on the outer peripheral surface of the photoreceptor 6.

On a bottom surface of the optical housing 23, there are formed opening portions 37, which are placed at positions opposite to the photoreceptors 6 of each of the printer engines 3, and which have thin and long shapes extended along a center line direction of the photoreceptor 6. On each opening portion 37, there is formed a translucent dustproof member 38 that permits transmission of the light beam and prevents dust from entering the optical housing 23, and the light beam directing to the photoreceptor 6 transmits through the translucent dustproof member 38 and travels forward. As the translucent dustproof member 38, for example, a flat glass is used.

Among the light beams passed through the focusing lens 29, the light beam passed through the end portion of the pre-scanning side of the focusing lens 29 is turned back by the synchronization detection mirror 32 and received through the focusing lens 33 by the photoelectric element 35. As a result of the beam reception by the photoelectric element 35, a synchronous signal for starting scanning is output from the photoelectric element 35. Here, the original meaning of the synchronization detection is to take scanning timing, and therefore the photoelectric element 35 can be provided at the position where the light beam is received prior to scanning. Further, in order to detect variations in one scanning rate (or time), the photoelectric element 35 can be provided on the back end side of scanning. The present embodiment shows the structure in which the synchronization detection mirror 32 and the photoelectric element 35 are provided on the pre-scanning side of the focusing lens 29 to take timing prior to scanning.

In this embodiment, all the light beams for synchronous detection are made to incident on one photoelectric element 35, and a position for obtaining synchronous detection beam, namely a synchronous detection signal obtaining angle for a scanning time period is slightly different to have a time difference between occurrence of synchronous signal and the scanning time in each opposing scanning system.

An explanation will be next given of a scanning line curvature adjusting apparatus 50, which is a characteristic part of the present invention. The scanning line curvature adjusting apparatus 50 is a mechanism for adjusting the amount of curvature of a scanning line on the photoreceptor 6 and is formed on each of the reflecting mirrors 30Y, 30C, 30M and 30K positioned on optical paths for Y, C, M, and K, respectively.

Moreover, in the image forming apparatus having this optical scanning apparatus, addition of only a simple and low-cost structure makes it possible to obtain an image with high preciseness and high quality and to improve a value of the product.

Figure 18:
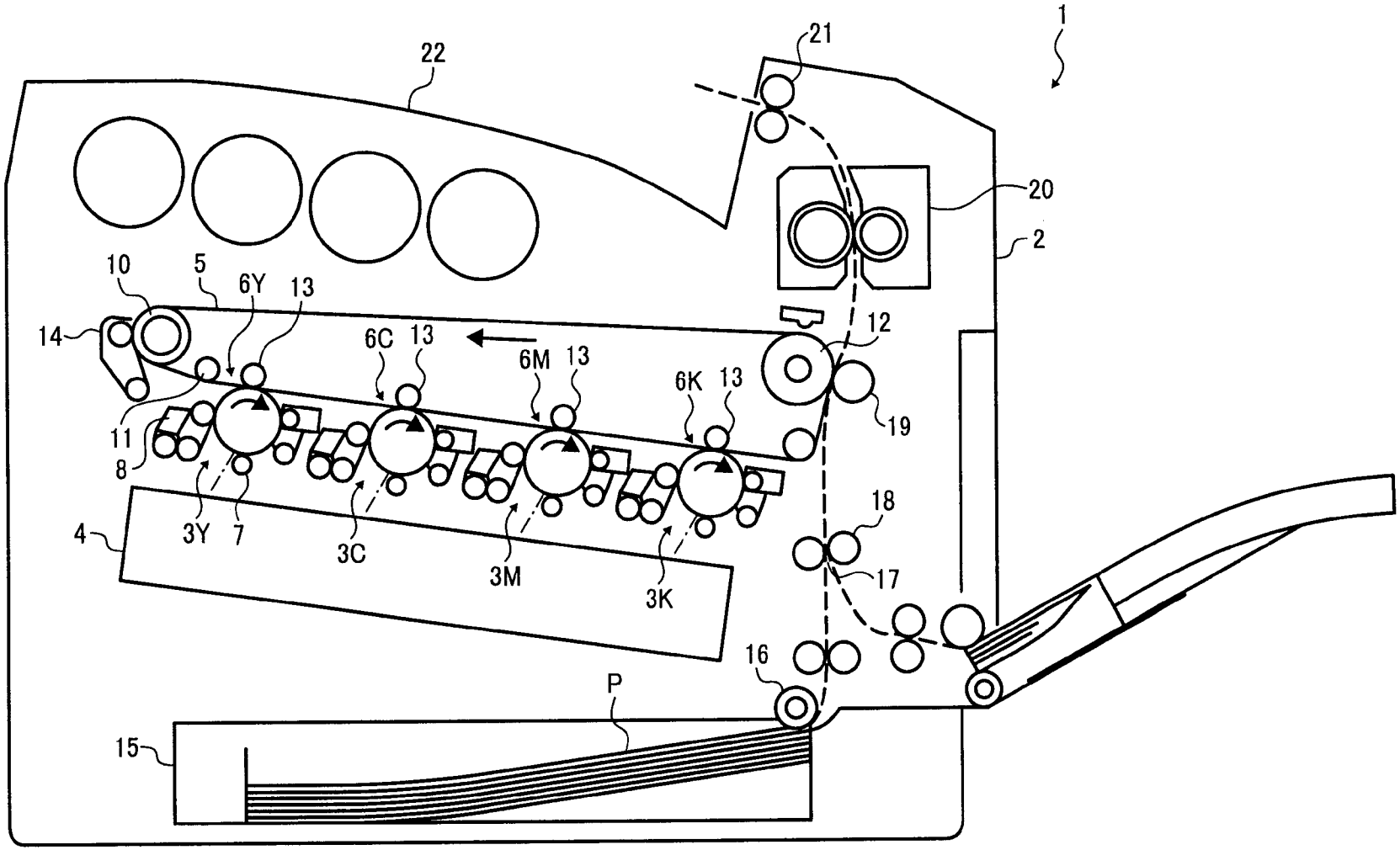
FIG. 18 is a schematic view showing one embodiment of an image forming apparatus according to the present invention.

Next, the entire configuration of the image forming apparatus will be explained. FIG. 18 shows one example of the image forming apparatus. More specifically, FIG. 18 schematically shows a color printer, that is, the image forming apparatus.

As shown in FIG. 18, in a substantially center of an interior of a main body case 2 of the color printer 1 as the image forming apparatus, there are arranged four printer engines 3 (3Y, 3C, 3M, 3K), an optical writing apparatus 4, which emits a light beam and irradiates each photoreceptor (to be described later) with a scanning line formed by the light beam, an intermediate transfer belt 5, and the like. Each printer engine 3 is a part that forms a toner image and has the same structure. Then, each printer engine 3 uses toner of a different color to form a toner image of a different color. In the descriptions of the present specification and drawings relating to these printer engines 3 and structural components of these printer engines 3, suffixes Y, C, M, K indicate colors of yellow, cyan, magenta, and black, respectively, and these suffixes are omitted as required.

Four printer engines 3Y, 3C, 3M and 3K have the same mechanical structure, and each printer engine includes a photoreceptor 6, which is rotationally driven in an arrow direction, a charging section 7 placed around the photoreceptor 6, a developing section 8, a cleaning section 9, and the like.

The photoreceptor 6 is cylindrically formed and rotationally driven by a drive motor (not shown), and a photosensitive layer is formed on an outer peripheral surface. The outer peripheral surface of the photoreceptor 6 is irradiated with the light beam emitted from the optical writing apparatus 4, thereby an electrostatic latent image is written on the outer peripheral surface of the photoreceptor 6 according to the image data.

The charging section 7 is a conductive roller member formed in a roller shape, and a charging bias voltage is supplied to the charging section 7 from a power-supply unit (not shown), thereby the outer peripheral surface of the photoreceptor 6 is charged uniformly.

The developing section 8 supplies toner to the photoreceptor 6. The supplied toner is adhered to the electrostatic latent image written on the outer peripheral surface of the photoreceptor 6 and the electrostatic latent image on the photoreceptor 6 is developed as a toner image.

The cleaning section 9 cleans residual toner adhered to the outer peripheral surface of the photoreceptor 6 after the toner image formed on the photoreceptor 6 is transferred onto the intermediate transfer belt 5. The intermediate transfer belt 5 is a loop belt obtained by forming a resin film or rubber as a base, and the toner image formed on the photoreceptor 6 is transferred thereon. The intermediate transfer belt 5 is supported by rollers 10, 11 and 12 and rotationally driven in an arrow direction. On the inner peripheral surface side (loop inner side) of the intermediate transfer belt 5, there are arranged four transfer rollers 13 for transferring the toner image on each photoreceptor 6 onto the intermediate transfer belt 5. Toner images formed on the respective photoreceptors 6 are transferred onto the intermediate transfer belt 5, sequentially, so that a color toner image is carried on the intermediate transfer belt 5. On the outer peripheral surface side (loop outer side) of the intermediate transfer belt 5, there is provided a cleaning section 14 for cleaning the residual toner, paper dust or the like adhered onto the outer peripheral surface of the intermediate transfer belt 5.

Under the four printer engines 3 and the optical writing apparatus 4 in the main body case 2, there is provided a paper feeding cassette 15 that stacks and retains recording media P. The recording media P stacked and retained in the paper feeding cassette 15 are sequentially separated and fed from the highest-positioned medium by a paper feeding roller 16.

In the main body case 2, there is provided a conveyance path 17 through which the recording media P separated and fed from the paper feeding cassette 15 are conveyed. On the conveyance path 17, there are arranged a resist roller 18, a transfer roller 19, a fixing section 20, a paper delivery roller 21, and the like.

The resist roller 18 is a roller that is intermittently rotationally driven at a predetermined timing. When the resist roller 18 is intermittently rotationally driven, the recording medium P, which has been conveyed to the position of the resist roller 18 and stopped there, are fed to the transfer position sandwiched by the intermediate transfer belt 5 and the transfer roller 19, the toner image on the intermediate transfer belt 5 is transferred onto the recoding medium P during the process when the recording medium P passes through the transfer position.

The fixing section 20 is a part that adds heat and pressure to the recording medium P onto which the toner image is transferred, and that melts toner and fixes the toner image to the recording medium P. The recording medium P to which the toner image is fixed by passing the fixing section 20 is delivered onto a paper delivery tray provided on the upper surface portion of the main body case 2 by the paper delivery roller 21.

According to the present invention, the pressure members 103 and 104 can deform the curving member 101 in an arcuate manner, a waveform manner and the like in its longitudinal direction while applying a load to both ends of the curving member 101 and the holding member 102, and therefore it is possible to easily set a predetermined curved surface.

Moreover, the pressure members 103 and 104 are ring-shaped and attached to the curving member 101 and the holding member 102 to move along the longitudinal direction of the curving member 101 and the holding member 102, and therefore it is possible to change magnitude of the moment acting on the curving member 101 and thus easily change the deformation of the curving member 101.

As mentioned above, according to the present invention, it is possible to provide a curved surface forming apparatus capable of forming a curved surface more easily, and to provide a useful optical scanning apparatus including such a curved surface forming apparatus, and further to provide a useful image forming apparatus including such an optical scanning apparatus.

Although the preferred embodiments of the present invention have been explained, the present invention is not limited to these embodiments, and specific forms and embodiments of the present invention can be changed or modified without departing from the broad spirit and scope of the invention.

For example, the curved surface forming apparatus according to the present invention can be applied to an optical apparatus having a precise surface to be used after adding a minute curvature thereto, and an optical scanning apparatus, which is required particularly for a precise adjustment of a scanning line curvature, and an image forming apparatus such as a printer, a copying machine, or the like that includes the optical scanning apparatus. Furthermore, the present invention can be applied to material processing for which precise curvature processing is required.

What is claimed is:

1. A curved surface forming apparatus comprising:

a first member to be curved;

a second member which is placed with a distance from the first member and holds the first member;

at least one spacer disposed between the first member and the second member, the spacer holding movably the second member and including a contact portion configured to be in contact with the first member, to maintain the distance between the first member and the second member; and a pressurizing mechanism which pressurizes the first member and the second member and curves at least a part of the first member at least toward the second member, wherein the first member and the second member include elongated members respectively which are arranged in parallel to each other, the spacer is placed at a central portion of each of the first member and the second member, and the pressurizing mechanism pressurizes both ends of the first member and the second member.

2. The curved surface forming apparatus according to claim 1, wherein the spacer includes a projection formed on the second member.

3. The curved surface forming apparatus according to claim 1, wherein the pressurizing mechanism has elasticity.

4. The curved surface forming apparatus according to claim 1, wherein the pressurizing mechanism includes a plurality of pressure members movable on the second member.

5. The curved surface forming apparatus according to claim 1, wherein material of the second member includes metal.

6. The curved surface forming apparatus according to claim 4, wherein at least one of side surfaces of the second member to be in contact with the plurality of pressure members has a changing profile surface which changes in its height direction.

7. The curved surface forming apparatus according to claim 4, wherein a surface of the second member to be in contact with the plurality of pressure members has an engaging structure capable of engaging with the plurality of pressure members.

8. The curved surface forming apparatus according to claim 4, wherein at least one of the plurality of pressure members is an elastic body.

9. The curved surface forming apparatus according to claim 4, wherein at least one of the plurality of pressure members has an engaging portion capable of engaging with the second member.

10. The curved surface forming apparatus according to claim 4, wherein at least one of the plurality of pressure members has at least one hole.

11. The curved surface forming apparatus according to claim 4, wherein each of the plurality of pressure members has a symmetric shape.

12. The curved surface forming apparatus according to claim 1, wherein the first member is an optical mirror.

13. A curved surface forming apparatus comprising:

an optical mirror having a mirror surface on a first surface of the optical mirror;

a holding member having at least one spacer on a first surface of the holding member, the spacer coming in contact with a second surface of the optical mirror; and at least one pressure member having an elastic body which holds the optical mirror and the holding member and curves the optical mirror toward the holding member, wherein a second surface of the holding member has a plane surface and a surface which changes such that, as a distance from the spacer in an arrangement direction of the holding member increases, a distance from the first surface of the optical mirror to the second surface of the holding member increases, and wherein the pressure member holds the optical mirror and the holding member while encompassing the second surface of the holding member and the first surface of the optical mirror and is movable in the arrangement direction of the holding member to change an amount of deflection of the optical mirror, and the pressure member comes in contact with an edge of the second surface of the holding member when the pressure member is occupying a position at which the distance from the first surface of the optical mirror to the second surface of the holding member being minimum.

14. The curved surface forming apparatus according to claim 13, wherein the pressure member is away from the edge of the second surface of the holding member when the pressure member is occupying a position at which the distance from the first surface of the optical mirror to the second surface of the holding member being maximum.

15. The curved surface forming apparatus according to claim 13, wherein the pressure member is placed such that the pressure member holds the optical mirror and the holding member without blocking light incident on the optical mirror even when the pressure member is occupying any position.

16. A curved surface forming apparatus comprising:

a first member to be curved;

a second member which is placed with a distance from the first member and holds the first member;

at least one spacer disposed between the first member and the second member, the spacer holding movably the second member and including a contact portion configured to be in contact with the first member to maintain the distance between the first member and the second member; and a pressurizing mechanism which pressurizes the first member and the second member and configured to curve at least a part of the first member, wherein a position of the pressurizing mechanism is configured to be changed with respect to the contact portion.

* * * * *